United States Patent [19]

Borodin et al.

[11] 3,964,285

[45] June 22, 1976

[54] PIPE CAGE END FORMING MACHINE AND METHOD

[75] Inventors: Daniel J. Borodin, Detroit; Wilbur E. Tolliver, Holland, both of Mich.

[73] Assignee: New York Wire Mills Corporation, Tonawanda, N.Y.

[22] Filed: Jan. 20, 1975

[21] Appl. No.: 542,342

[52] U.S. Cl. ..... 72/69; 140/107; 83/559; 72/80; 72/205

[51] Int. Cl.[2] ..... B21F 33/00; B21B 5/00

[58] Field of Search ..... 140/107, 112; 72/69, 72/80, 205, 110; 83/337, 559; 219/7.5, 8.5

[56] References Cited

UNITED STATES PATENTS

| | | | |
|---|---|---|---|
| 478,670 | 7/1892 | Welch | 72/69 |
| 3,644,695 | 2/1972 | Shuey et al. | 219/8.5 |
| 3,847,005 | 11/1974 | Criner | 140/107 |

*Primary Examiner*—Lowell A. Larson
*Attorney, Agent, or Firm*—Price, Heneveld, Huizenga & Cooper

[57] ABSTRACT

The specification discloses apparatus and a process for forming the female or bell end of welded wire reinforcing cages, particularly cages of the type used to reinforce concrete pipe. A cylindrical wire cage assembly is automatically centered and positioned within the apparatus and the bell end is formed by elongating one or more of the circumferential wires at one end of the cage. A force is applied between two points on the circumferential wires to simultaneously expand the wires and rotate the cage. A heat source is applied to a localized zone between the two points on the wire. The heat source and wire are moved relative to each other such that the heat zone moves along the wire as the force is applied. The wire is stretched under the force being applied to thereby continuously reduce the diameter of the wire and elongate the wire as it is moved relative to the heat source.

49 Claims, 28 Drawing Figures

$N_1$ = RPM SLOW ROLLERS (UPSTREAM)
$N_2$ = RPM FAST ROLLERS (DOWNSTREAM)

FROM SOURCE

XX
XX

PIPE CAGE END FORMING MACHINE AND METHOD

BACKGROUND OF THE INVENTION

The present invention relates to novel apparatus and a method for forming the wire reinforcing cage utilized in the manufacture of concrete pipe. In particular the invention relates to the formation of the bell-shaped or female end of the reinforcing wire cage.

Prior techniques for fabricating and forming the bell end of such cages have typically involved manually cutting the circumferential wires at the bell end of a cylindrically formed cage, bending the transverse wires to define a bell shape and then wrapping a wire circumferentially around the bent out transverse wires and welding it thereto. An improved apparatus illustrated in Nordgren, U.S. Pat. No. 3,661,186 entitled Apparatus and Process For Making Concrete Pipe Reinforcement Member, issued May 9, 1972, significantly improved upon prior techniques in its provision of an apparatus including an adjustable mandrel mechansim which expanded the transverse wires at one end of the cage. The expanded wires then formed the bell end and were wrapped with a circumferential wire which was then welded thereto.

Other prior techniques have utilized corrugated or serpentine-shaped circumferential wires at the bell end, which are adapted to be stretched into the bell-shaped end by means of an expansion mandrel. These and other prior techniques, however, are relatively slow in operation and actually require many additional manual steps to form a cage to completion. The corrugated wire construction, although desirable from some aspects, leads to too much flexibility at the bell end of a completed pipe and concrete cracking may, under some circumstances, result. Also such fabric results in the extra expense of manufacturing the wire to have a corrugated configuration and the subsequent welding of the corrugated wire to the transverse wires.

SUMMARY OF THE INVENTION

The present invention provides an apparatus and a process for forming the bell or female end of a welded wire reinforcing cage. The apparatus of the present invention is uniquely adapted to automatically center, position, form the bell end and trim the ends of the transverse wires into the desired bell end configuration without the need for special fabric and without the need for manual welding and cutting operations. Various size wire cages can be handled with equal facility. The invention includes generally a support framework means for holding and centering a wire cage to extend the framework, and means for supporting the cage end while simultaneously allowing rotation thereof and bell forming means including a wire elongation apparatus adapted to elongate the circumferential wires at the opposite end of the cage to form generally a bell end.

The wire elongating apparatus includes a novel mechanism wherein a force is applied between two points along the length of the circumferential wires at the end which is to be bell-formed. The force is applied by two sets of rollers which drive in the same direction but at different speeds. A heat source is provided between the two sets of rollers for lowering the yield point of the wire to a point where it will be elongated under the force being applied by the rollers. One of the sets of rollers operates at a faster rate than the other thereby tending to pull the wire therethrough. The other set of rollers, while allowing the wire to move at a given rate restricts the speed at which the wire moves through the first roller thereby causing the wire to stretch at the heated zone. The rollers both apply the stretching force to the wire and also move the wire thereby rotating the cage. The heat source is therefore in a fixed position and the wires continuously stretch to a desired length as they move between the pairs of rollers past the heat zone. As the wire is stretched the cage is rotated such that the entire length of the circumferential wire or wires is formed to have a larger diameter thus forming the bell-shaped end of the cage.

Many additional features, advantages and objects of the present invention will be readily understood and appreciated by those skilled in the art with reference to the following specification and the accompanying drawings.

DESCRIPTION OF THE PREFERRED EMBODIMENT

Figure 1:
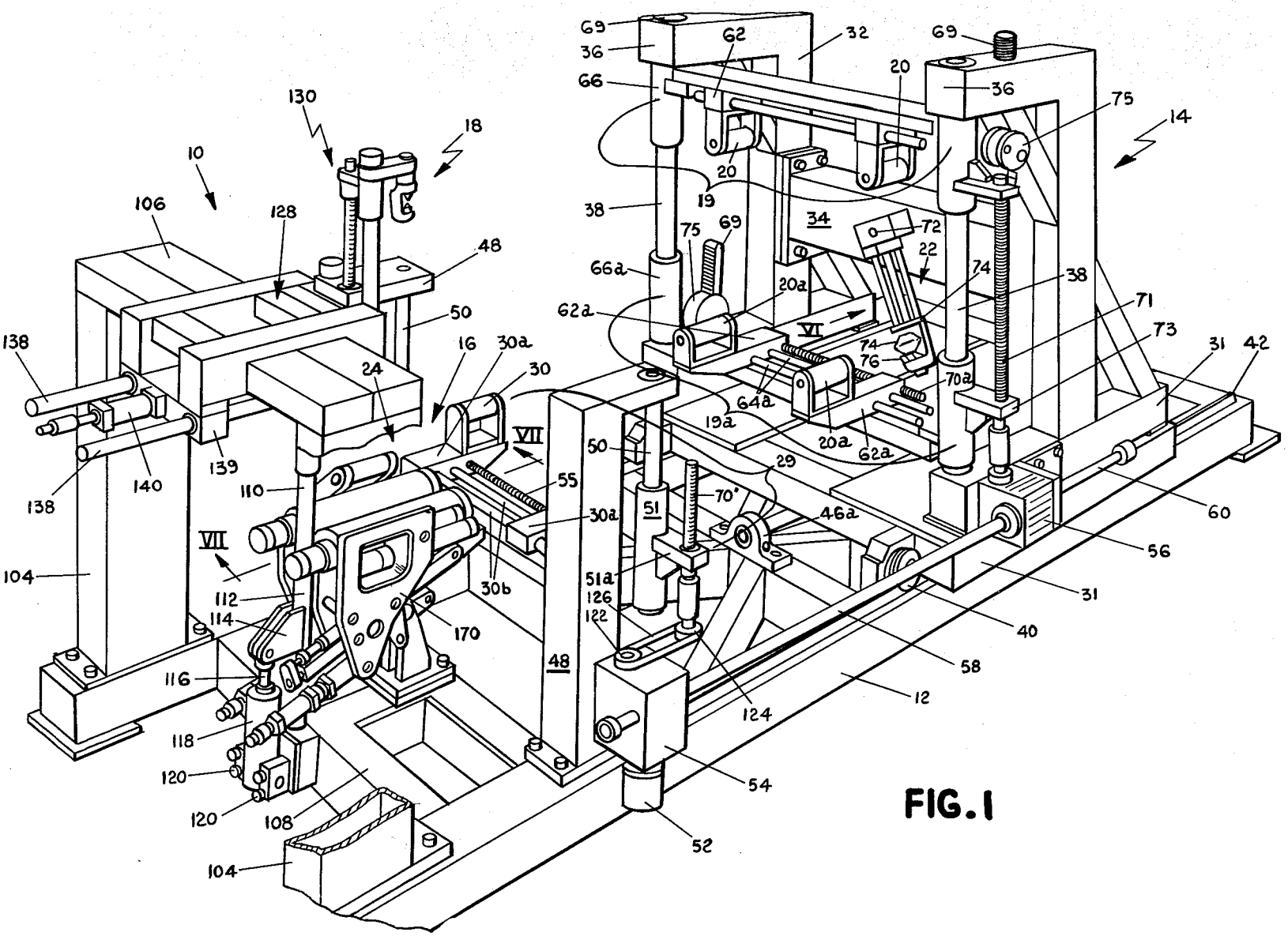
FIG. 1 is a partial fragmented perspective view illustrating the apparatus of the invention in somewhat schematic form.
Figure 2:
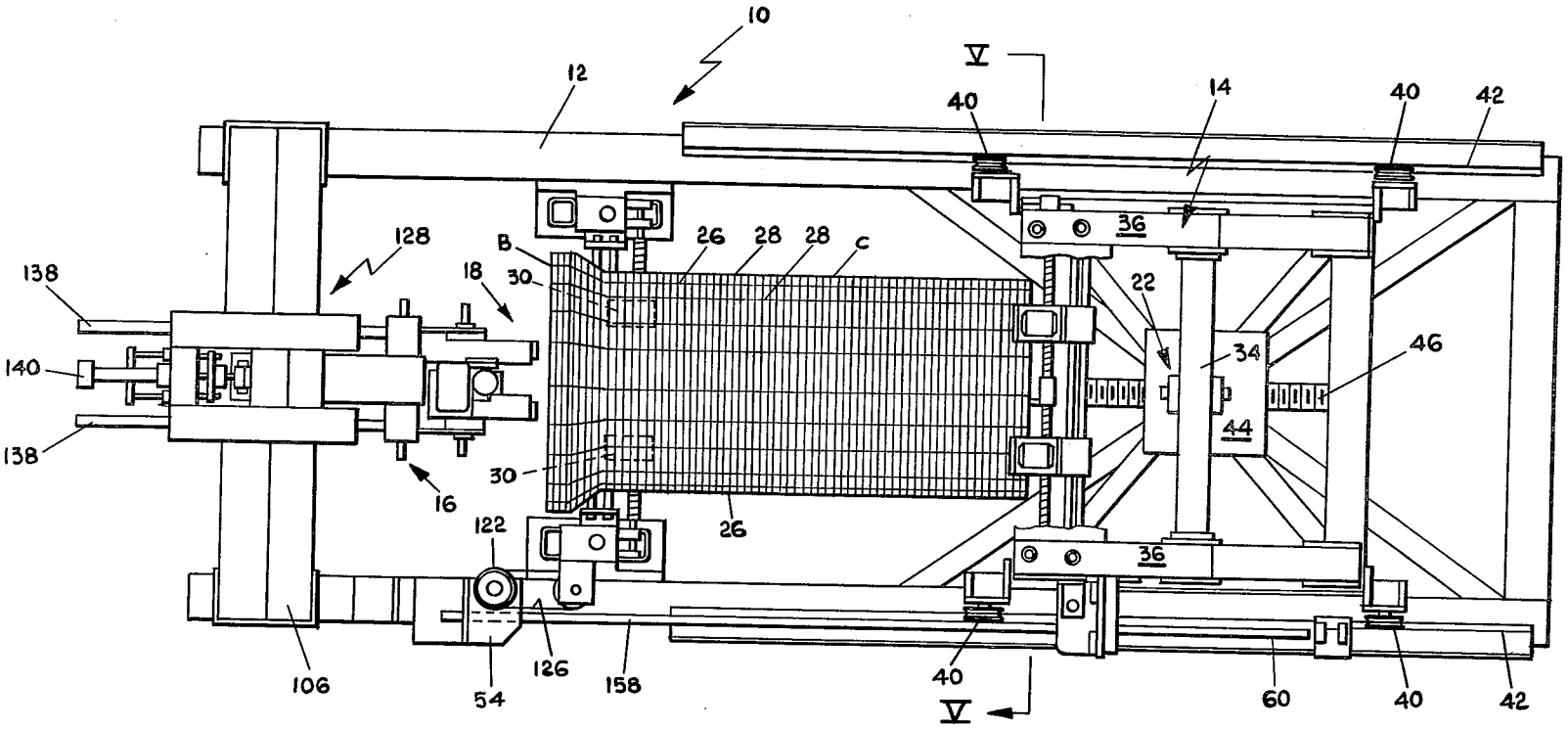
FIG. 2 is a top plan view of the invention with a formed cage positioned therein after the bell end forming is completed.
Figure 3:
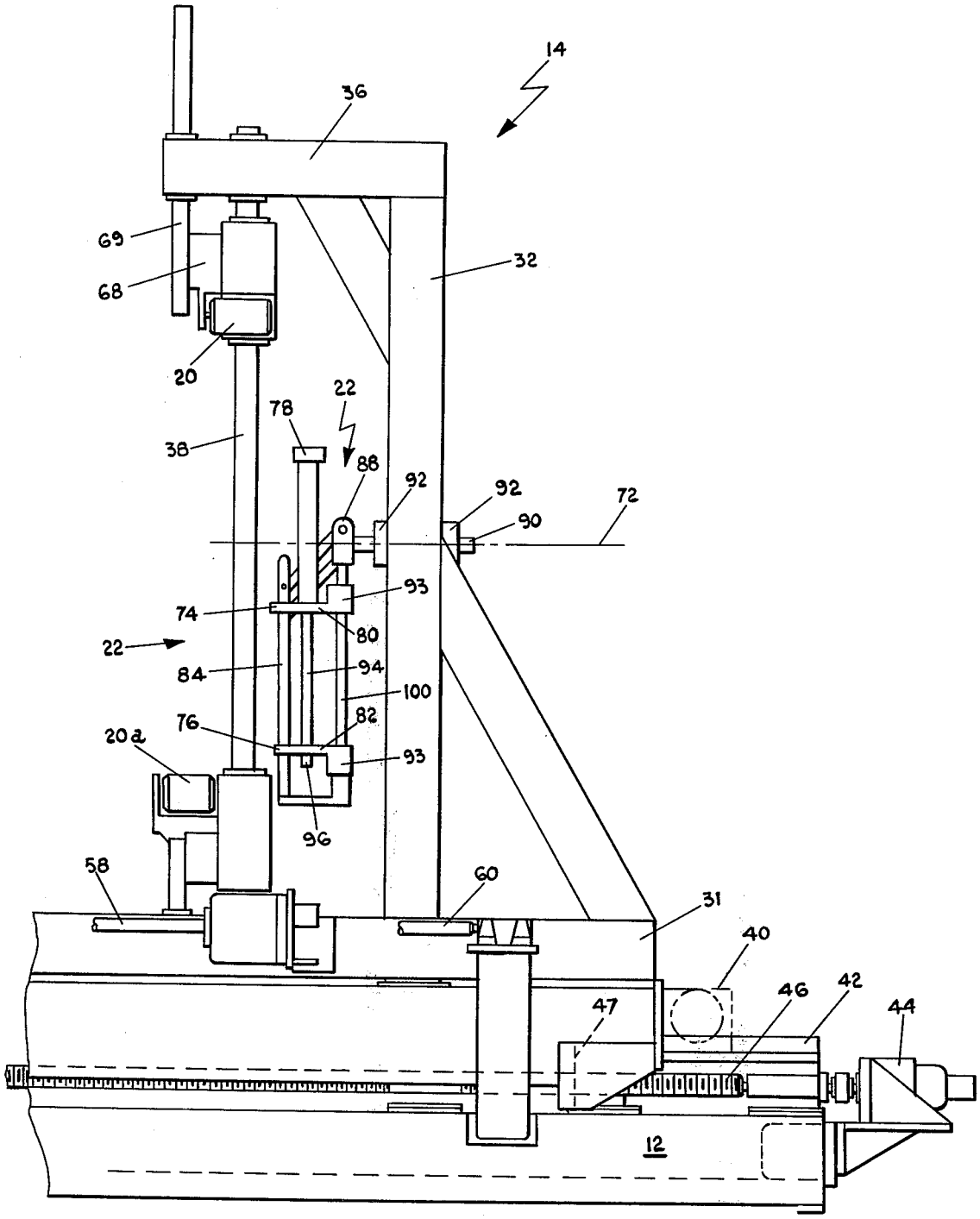
FIG. 3 is a side elevational view of the carriage assembly.
Figure 4:
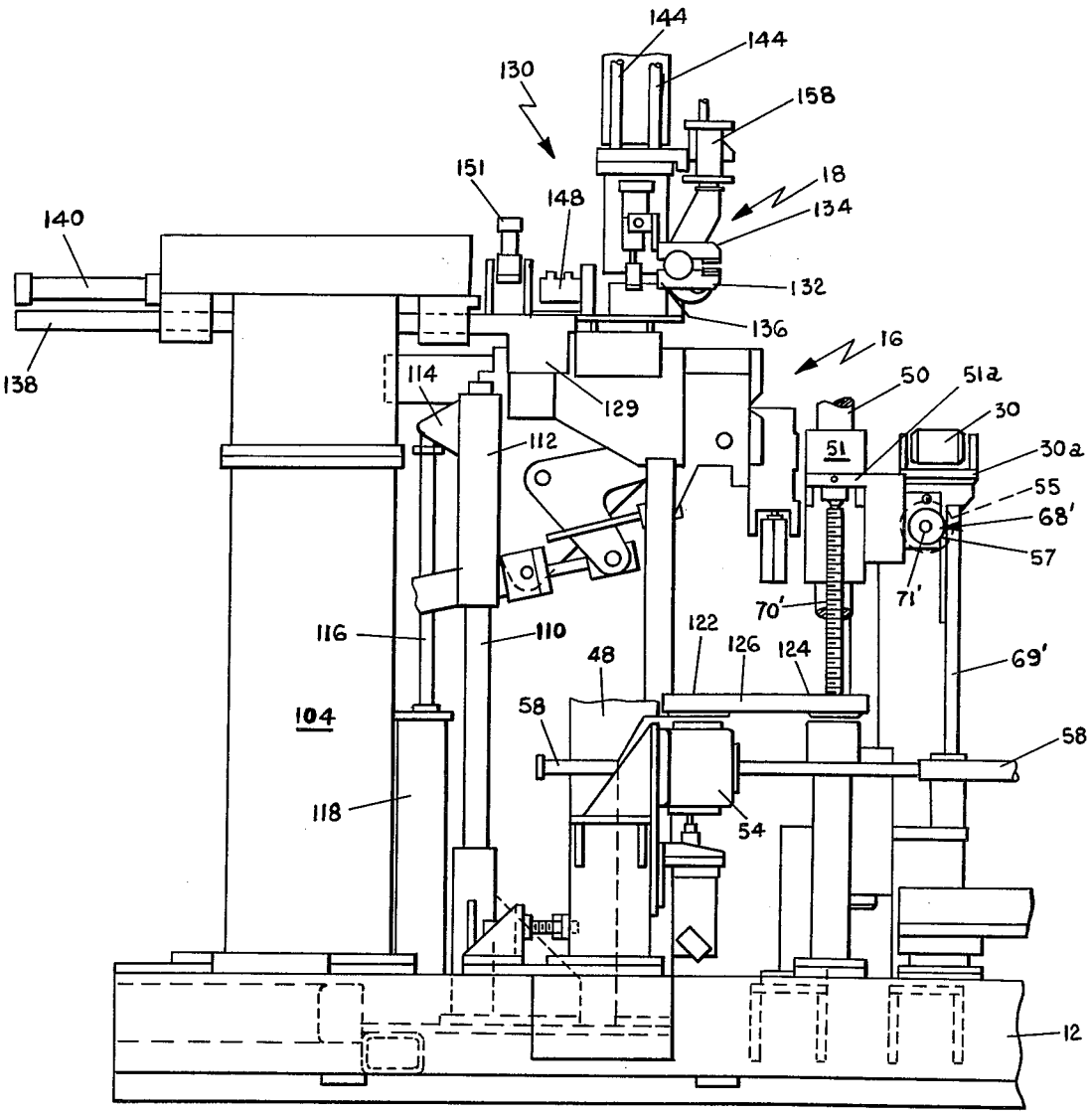
FIG. 4 is a side elevational view of the forward or bell forming end of the apparatus.

Referring now to the drawings and in particular FIGS. 1, 2, 3 and 4, the apparatus of the invention generally designated by the numeral 10 includes a main supporting framework or base 12 having a cage holding and positioning carriage 14 mounted at one end of the base and movable along its length; a bell end forming or wire elongating assembly 16; and a trimmer assembly 18. The apparatus is adapted to receive a welded wire reinforcing cage assembly indicated by the letter "C" (FIG. 2), which is centered within the apparatus by means of a plurality of chucking and centering roller 20 and 20*a* mounted on carriage 14 (FIGS. 1 and 3). A grabber mechanism 22 pivotally mounted on carriage 14 holds one end of the cage. Carriage 14 and the cage positioned and carried thereby is movable along base 12 such that the opposite or front end "B" of the cage may be advanced toward and into operative relationship with the forming or elongating assembly 16 (FIGS. 1 and 4). As will be described in greater detail hereinafter, the cage is rotatable as a bell end B is formed thereon by means of rollers and heating means which are positioned within and form a part of the forming assembly 16. A truing roller assembly 24 movable into engagement with the outer diameter of the formed bell end operates to restore the curvature to the bell end of the cage. Finally, trimmer assembly 18 clips any remaining longitudinal wire ends extending from the circumferential wires which are stretched to form the bell end.

The wire cage C is of conventional construction having a plurality of transverse wires 26 and circumferential wires 28 welded together forming an elongated cylindrical cage-like structure (FIG. 2). The cage is positioned within the apparatus from above by an overhead crane or the like (not shown). The cage rests on a forward pair of lower movable support and positioning rollers 30 and lower rear supporting rollers 20*a* (FIG. 1). The upper pair of rollers 20 and the lower pair of rollers 20*a* on a carriage 14 and rollers 30 of the front of the apparatus are adapted for movement toward and away from each other and also vertically as will be hereinafter described to engage the cage assembly in the manner of a chuck to center and to position the cage along the general center line of the apparatus.

THE CARRIAGE ASSEMBLY

Carriage assembly 14 includes a base portion 31 from which a pair of upwardly directed support columns 32 extend with horizontal beam 34 extending therebetween (FIG. 1). Each upright includes a forwardly directed portion 36 at its top which form the upper support mechanism for a pair of guide columns 38 upon which roller assemblies 19 and 19*a* are mounted for vertical movement. The entire carriage assembly is mounted on wheels 40, joined to carriage base 31, corresponding track members 42 extending along the length of and at each side of base 12. Carriage 14 is movable along tracks 42 by a motor 44 (FIG. 3) fixed on the rear of base 12 and which drives a screw 46 received in threaded block 47 fixed on the underside of carriage base 31 in a generally conventional manner whereby operation of motor 44 urges carriage 14 to advance along screw 46. The other end of screw 46 is received in a bearing 46*a* mounted on a cross beam of base 12 (FIG. 1).

Figure 5:
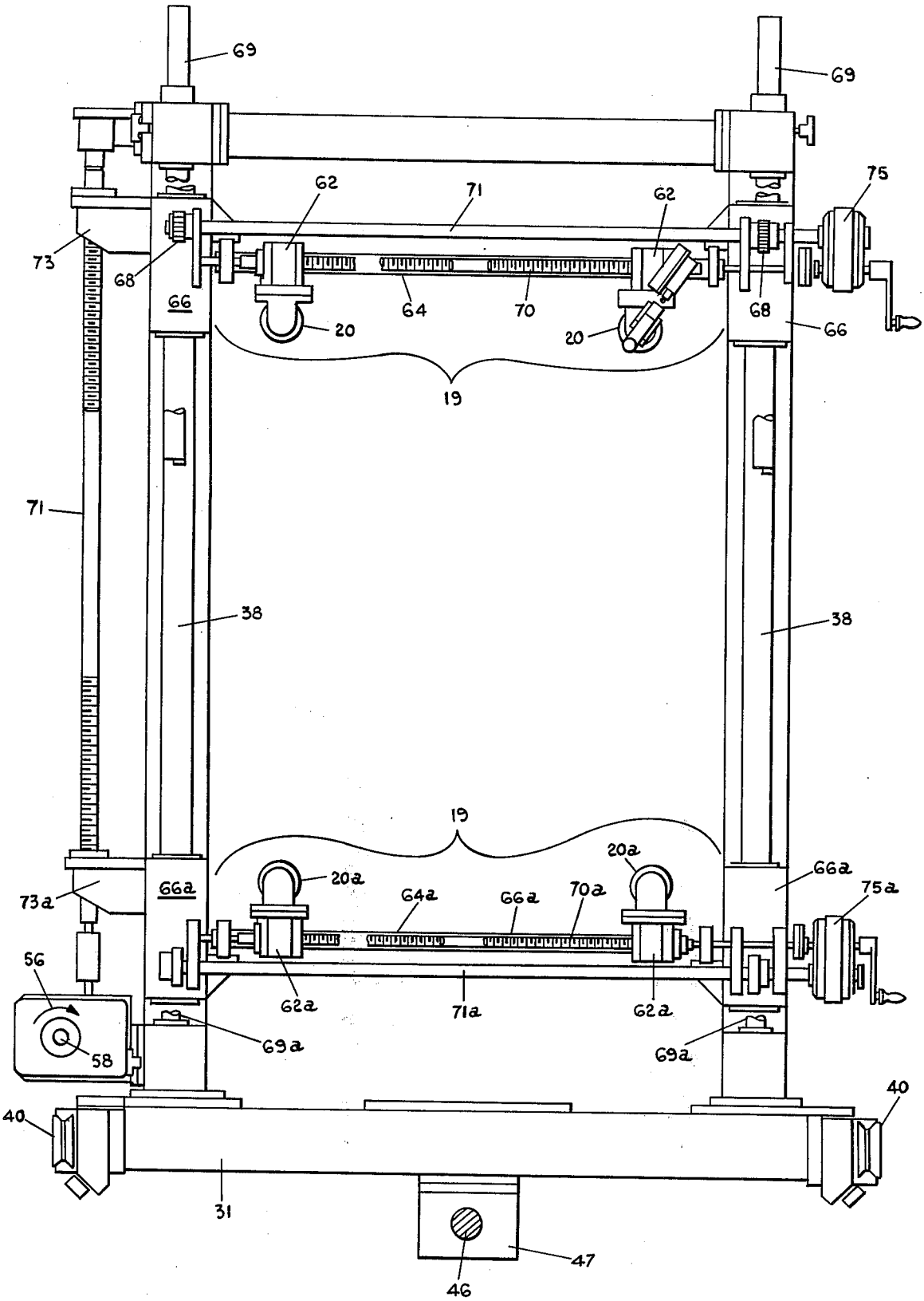
FIG. 5 is a cross-sectional view taken along the plane V—V of FIG. 2 illustrating the carriage and chucking mechanism used to cradle the cage during bell forming.

With additional reference to FIG. 5, the upper and lower roller assemblies 19 and 19*a* included upper rollers 20 and lower rollers 20*a*, each mounted on a movable block 62. Each movable block 62 is in turn supported on a pair of fixed, spaced apart, guide rod members 64 (see also FIG. 1, as well as FIG. 5). The guide rods are carried on sleeve members 66 at each side of the machine and sleeve members 66 are mounted for vertical movement on the previously mentioned support columns 38. Since the upper roller assembly 19 is basically identical to the lower support roller assembly 19*a*, like components are identified with like reference numerals. The components associated with the lower support roller assembly 19*a* are further identified with the suffix letter "a".

An elongated lead screw 70 having left and right hands threads at opposite ends thereof is threadedly received in each block 62 such that upon rotation, blocks 62 will move toward or away from each other on guide rods 64. Rotation of screw 70 is obtained by rack 69 and pinion gear 68 assemblies (FIG. 1). The rack 69 is vertically oriented and is fixed mounted on upper frame piece 36 in the case of upper roller assembly 19 and on base 31 in the case of lower roller assembly 19*a*. The pinion 68 is, of course, fixed on the end of its synchronizing shaft 71. Upon vertical movement of the roller assembly, the pinion is rotated by the fixed rack, this rotation is simplified by transmission 75 which drives screw 70 causing a corresponding movement of blocks 62 toward or away from each other.

Vertical movement of the upper and lower roller assemblies 19 is caused by moving sleeves 66 vertically upwardly or downwardly along guide columns 38. Sleeves 66 on one side of the apparatus are equipped with outwardly extending threaded flanges 73 (FIG. 1) which receive opposite ends of a threaded lead screw 71. The threads at one end of the lead screw 71 are right-hand while those at the other end are left-hand such that rotation will cause the associated flanges 73 to move away from each other or towards each other with rotation of lead screw 71. The lead screw is fixed at its base in gear reducer 56 which is mounted on carriage base 31. A spline shaft 58 having a spline 60 extends through gear reducer 56 along the side of base 12 and is driven at one end by a motor 52 mounted to base 12. As screw 71 is thus rotated to move the upper and lower roller assemblies 19 and 19*a*, for example toward each other, corresponding engagement of the rack 69 and pinion gear 68 will urge blocks 62 to simultaneously move toward the center thereby forming a chuck-like action to center and position a cage located therein along the centerline of the apparatus. The changing positions of the rollers 20 and 20*a* also accommodates different size cages.

A pair of front rollers 30 are functionally associated with carriage 14 in that they serve as a support for a cage. However, rollers 30 are not mounted on carriage 14. Rather, a forward pair of uprights 48 mounted on base 12 each support guide columns 50 to which front support roller assembly 29 is mounted for vertical movement. Just as vertical movement of rollers 20 and 20*a* is accomplished by means of motor 52, motor 52 also operates a gear reduction assembly 54 mounted on base 12 and associated with front rollers 30 for shifting them vertically up or down. Rollers 30 are mounted on blocks 30*a* which in turn slide on a pair of guide rods 30*b* mounted on sleeves 51. Sleeves 51 are slidably mounted on support columns 50. Blocks 30*a* are threaded on opposite ends of lead screw 55 (oppositely threaded) and lead screw 55 is driven by transmission 57 which in turn is driven by synchronizing shaft 71' on which two pinions 68' are mounted (FIG. 4). Pinions 68' are engaged by racks 69' mounted to base 12 at the forward end of the apparatus. Drive motor 52 for spline shaft 58 also drives gear reducer 54 which includes a first pulley wheel 122 which via belt 126 drives a second pulley wheel 124 to which lead screw 70' is joined (FIGS. 1 and 4). Lead screw 70' is threaded in a threaded bearing fixed to flange 51*a* which in turn is fixed to sleeve 51. This raises and lowers the support roller assembly 29.

As assembly 29 is raised and lowered, pinion 68' engaging rack 69' is rotated, thus turning lead screw 55. This causes roller support blocks 30*a* to thread inwardly or outwardly relative to one another. In this manner, the relative movements and positions of lower rollers 20*a* at the rear of the machine are duplicated by rollers 30 at the forward portion of the machine.

CAGE GRABBER MECHANISM

Simultaneously with the centering and positioning facilitated by carriage assembly 14, grabber mechanism 22 engages and holds the end of the wire cage C opposite the end at which bell portion B is to be formed to hold the cage from axial movement.

Figure 6:
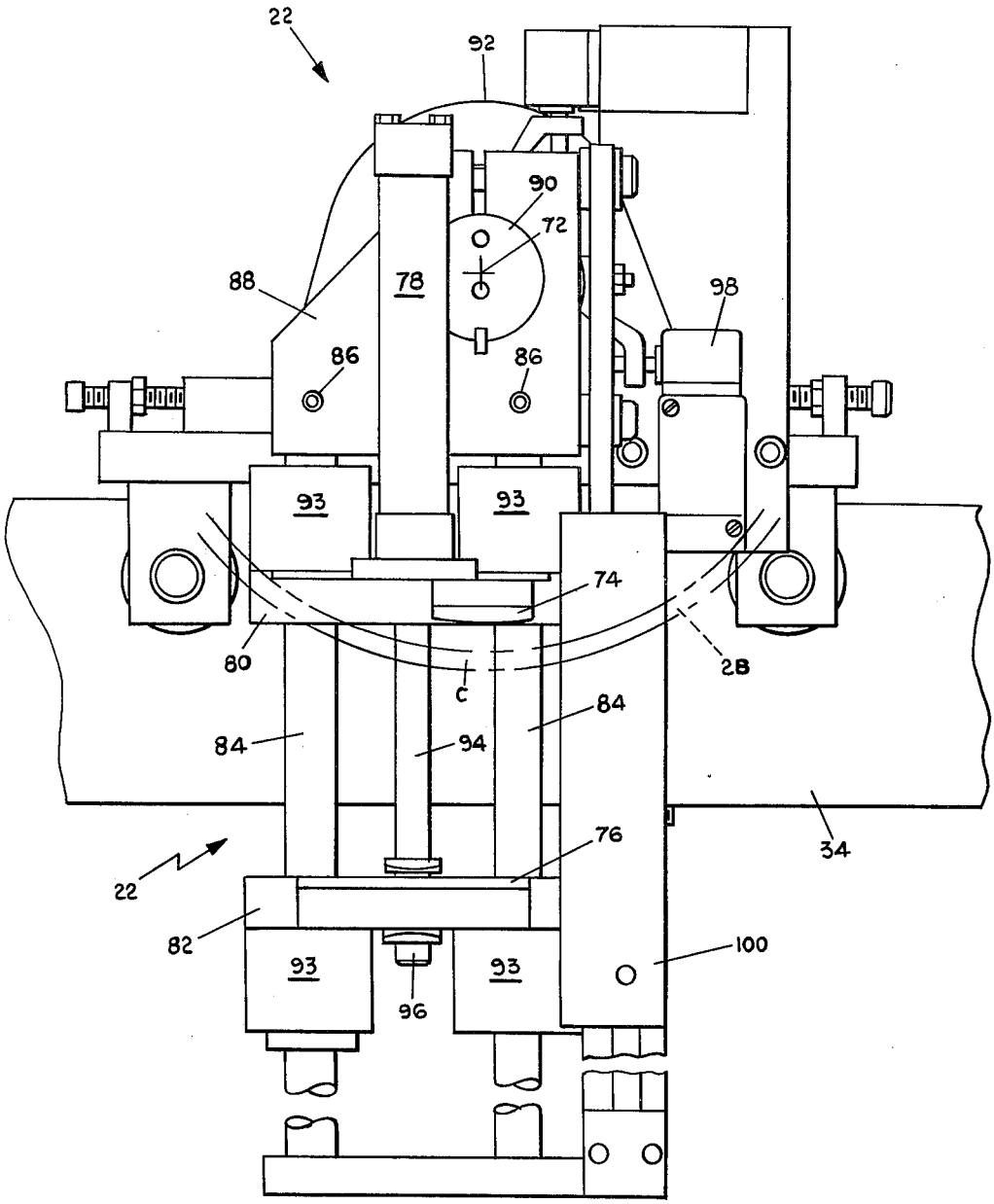
FIG. 6 is a partial elevation view as viewed along the arrow VI of FIG. 1 illustrating the grabber mechanism for gripping the non-formed rear end of the cage during forming.

Grabber 22 is pivotally mounted to horizontal beam 34 of carriage 14 and pivots about a point 72 along the centerline of the apparatus (FIG. 1). The grabber, shown in greater detail in FIG. 3 and additionally in FIG. 6, includes an upper jaw member 74 and a lower jaw member 76 jointly operated by cylinder 78 to receive and grip therebetween the end circumferential wire or wires 28 of the cage on one side of the cage. The upper and lower jaws are fixed on upper and lower mounting members 80 and 82, respectively. Each of the mounting members are slidably mounted on a pair of spaced apart guide rod members 84. Guide rods 84 are fixed at their upper ends by a pin 86 in a pivot block 88 which in turn is mounted so as to pivot about point 72. The pivoting arrangement for pivot block 88 may be in the form of a shaft 90 mounted for rotation in pillow blocks 92. Upper mount 80 and lower mount 82 each include a pair of spaced apart flanges 93 for sliding movement on guide rods 84.

Cylinder 78 is fixed on upper mount 80 and includes an extendible and retractable piston rod 94 which is fixed at its lowermost end 96 to the lower jaw mounting member 82. As cylinder 78 is energized to retract the piston rod, piston rod 94 moves into cylinder 78 and jaws 74, 76 (both freely slidable on guide rods 84) move toward each other and into engagement with the circumferential wires at the end of the cage. Since the grabber is free to pivot about shaft 90 and the cage is relatively rigidly held by the grabber, axial shifting of the cage is prevented. The sliding movement of the upper and lower jaws with respect to each other allows the grabber to automatically compensate for cages of varying sizes. The cage, when originally placed within the apparatus, between the previously described roller assemblies 20 and 20*a* is also positioned between the spaced apart jaws of the grabber. As rollers 20 and 20*a* close to position the cage within the apparatus, the circumferential wires on the cage will gradually engage the upper jaw, sliding the jaw, mount 80 and cylinder 78 upwardly such that upon acutation of cylinder 78, the lower jaw will move upwardly to thereby engage the cage.

Conventional sensing means 98 or a limit switch mounted to block 88 is actuated by a pivotally mounted elongated abutment plate 100 which moves to operate switch 98 as plate 100 is contacted by the end of the cage. Switch 98 provides the signal to maintain the jaws in open position until the cage is positioned therebetween.

BELL FORMING APPARATUS

Figure 10:
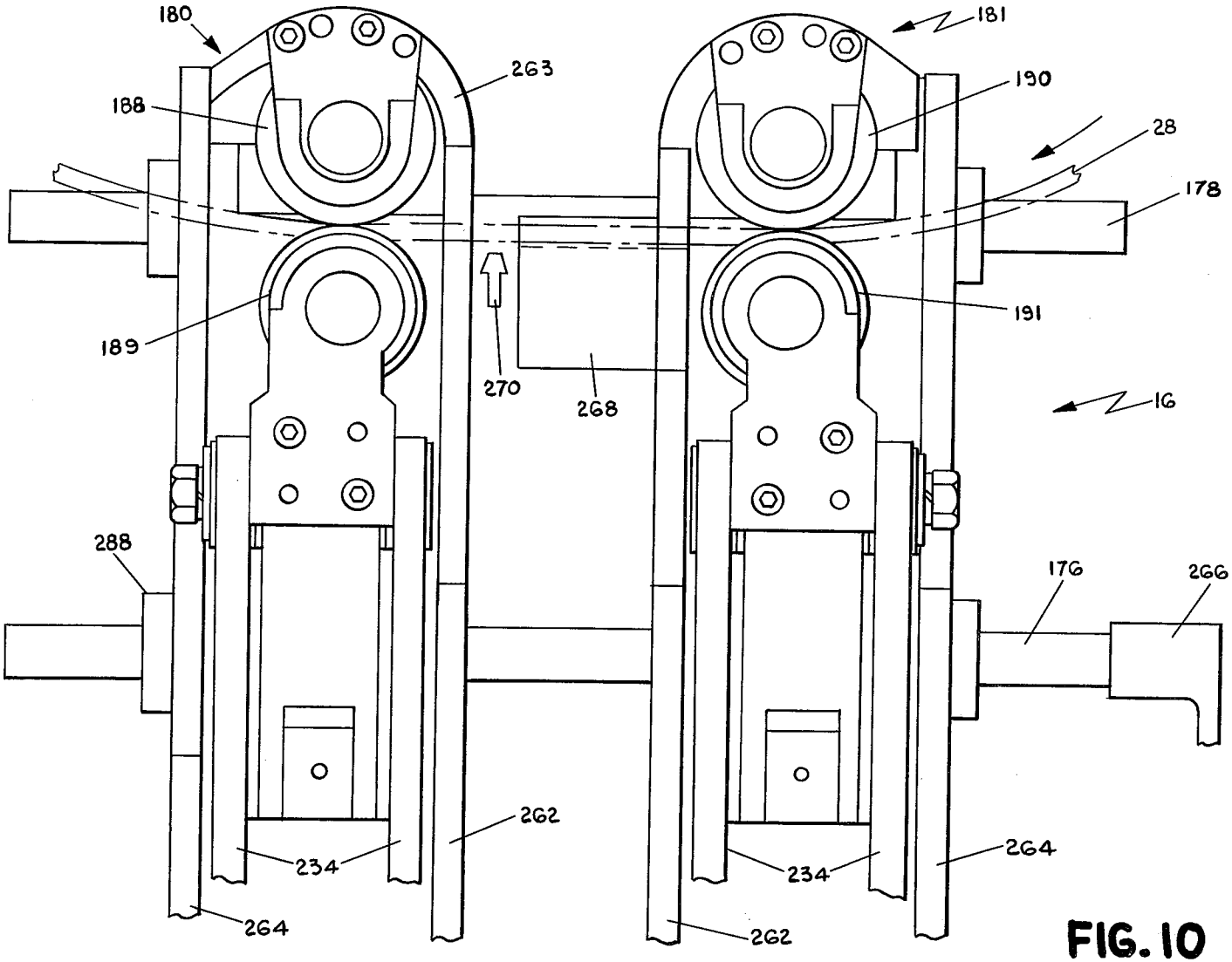
FIG. 10 is a partial end view of the head assembly.

The heart of the forming assembly 16 are the two pairs of spaced apart rollers driven at different speeds shown in FIG. 10 in their wire engaging and elongating position. For convenience in reference roller support subassembly 181 which contains rollers 190 and 191 will be referred to as the upstream rollers while the roller support subassembly 180 containing rollers 188 and 189 will be referred to as the downstream rollers. The terms upstream and downstream are made with reference to the direction of travel of a circumferential wire 26 passing through the apparatus. A heat source 268 is positioned between the upstream and downstream rollers to heat the circumferential wires to a point at which they can readily be elongated by the elongating force generated by the rollers. A nozzle 270 adapted to direct a spray of coolant as for example water on the wire is positioned between the heat source 268 and the downstream rollers 180 to quench the wire immediately after it is elongated.

The bell forming assembly 16 is located at the front end of machine 10. A pair of upwardly extending support members 104 mounted on base 12 and an upper transverse horizontal cross beam 106 extending therebetween provide a frame for forming assembly 16 (FIGS. 1 and 4). A lower horizontal H-shaped beam assembly 108 extends between the sides of base 12 and generally parallel to the upper horizontal beam 106. A vertical support and guide post 110 extending between upper and lower horizontal members 106 and 108, respectively, provides the supporting means and guide means for forming assembly 16. Forming assembly 16 is mounted on vertical guide post 110 by means of a sleeve 112 having outwardly extending ears 114 thereon which connect to the movable piston rods 116 of a pneumatic cylinder or actuator 118. Actuator 118, in turn, is mounted to the H-beam assembly 108 and is utilized to control the vertical positioning of forming assembly 16 on guide post 110.

Figure 7:
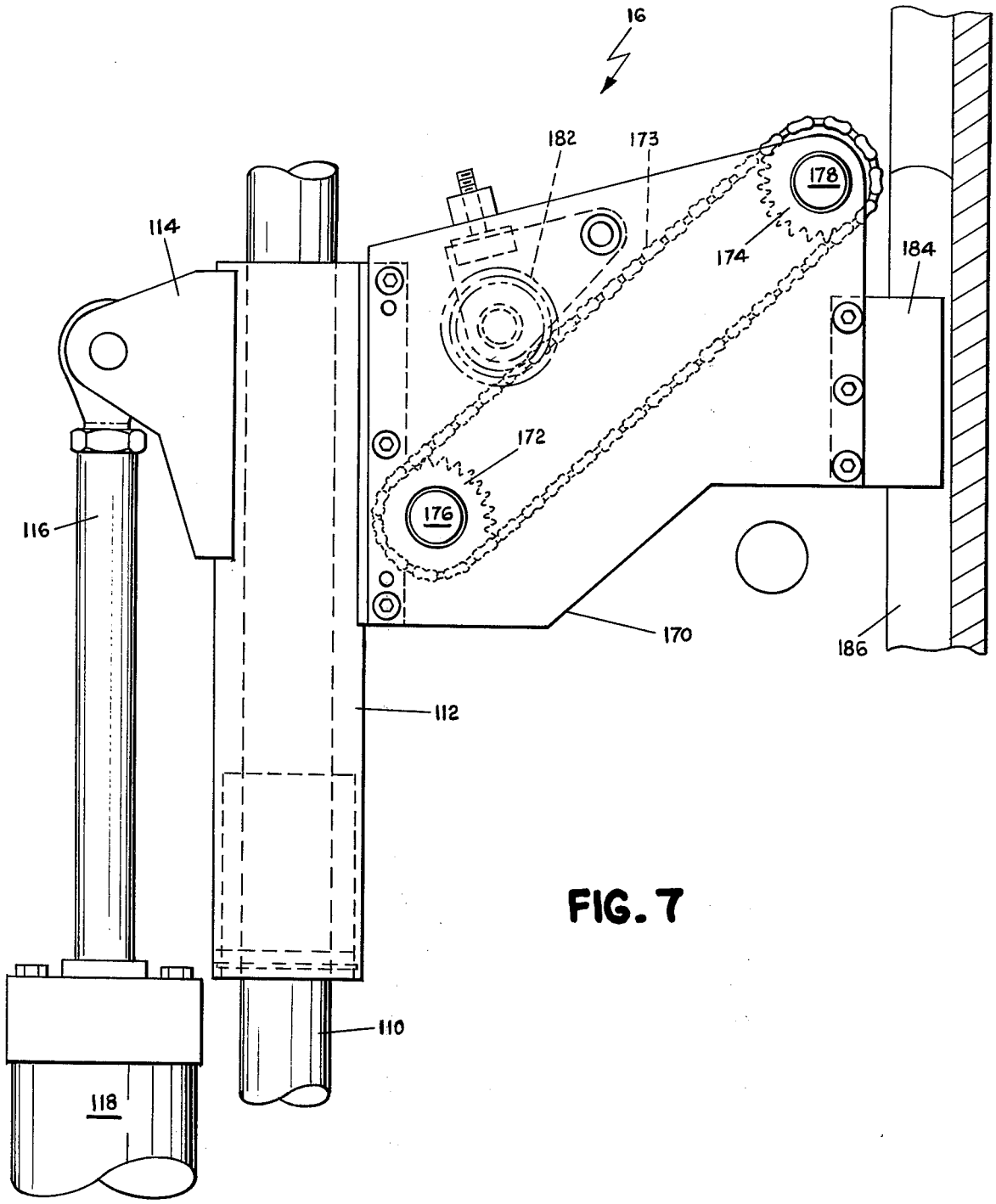
FIG. 7 is a fragmentary cross-sectional view of the mounting portion of the elongating or forming head assembly as viewed along the plane VII—VII of FIG. 1.
Figure 8:
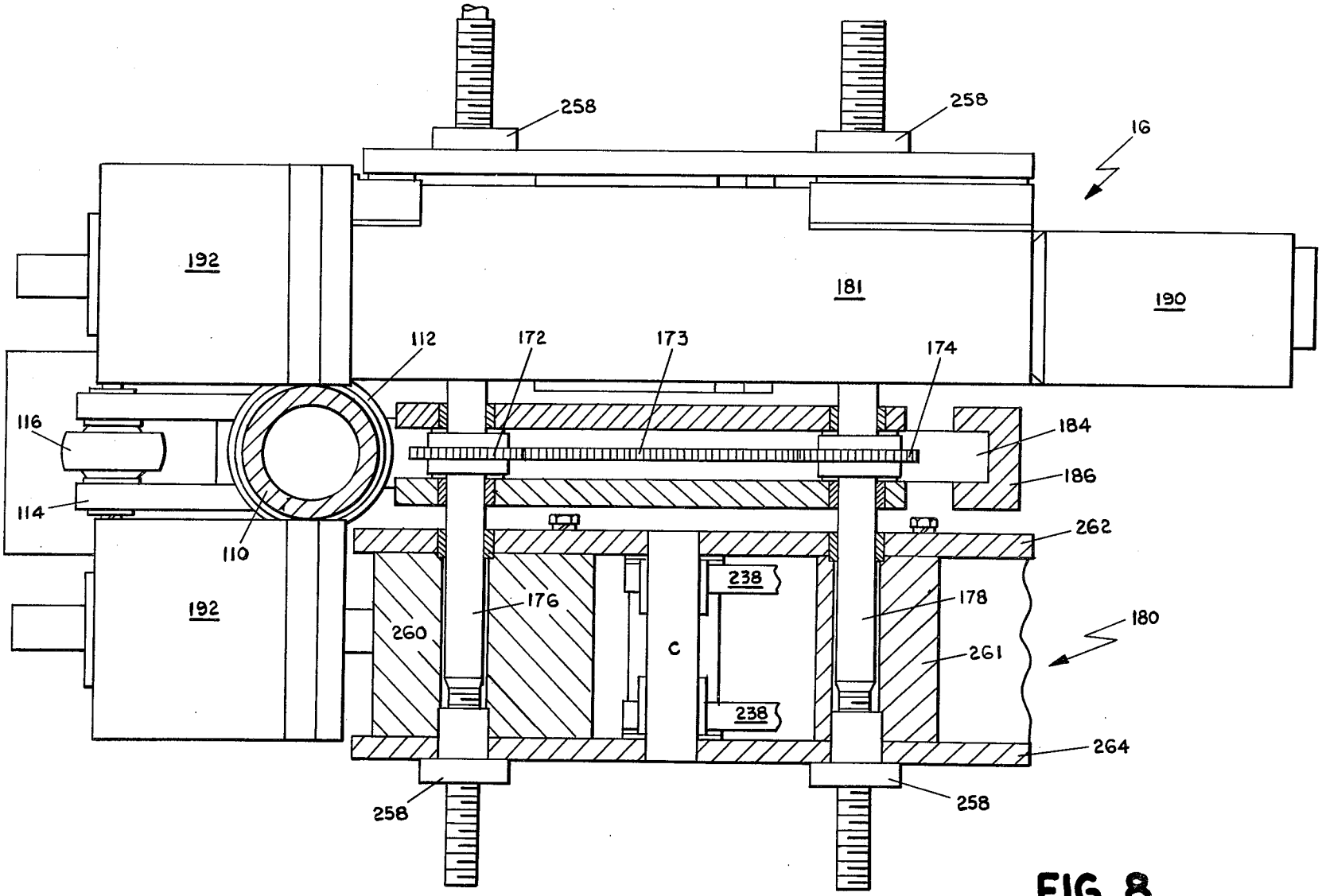
FIG. 8 is a fragmentary top plan view of a portion of the elongating or forming head assembly with details omitted for clarity.

The forming assembly or head 16 is shown in greater detail in FIGS. 7, 8, 9 and 10. The forming head 16 includes a central supporting framework 170 comprised of oppositely disposed plates connected at one end to and movable with sleeve 112 on vertical support post 110 (FIGS. 7 and 8). Framework 170 (FIG. 10) has an adjustment mechanism contained therein between its plates, including a pair of sprockets 172, 174 connected by a chain 173 to jointly drive a pair of transversely extending lead screws 176 and 178, respectively. Lead screws 176 and 178 have left and right-hand threads at the ends thereof thereby providing means to both support and adjust a pair of roller support subassemblies 180 and 181 positioned on each side of the central supporting framework 170. An adjustable idler 182 (FIG. 6) is positioned between the plates of framework 170 for maintaining the proper tension on the drive chain 173.

The lead screws pass through threaded bushings 258 (FIG. 8) positioned in the outer facing side plate 264 of roller support subassemblies 180 and 181. Suitable guide and supporting blocks 260 and 261 (FIG. 9) are provided within roller support subassemblies 180 and 181 to receive and guide lead screws 176 and 178. Guide blocks 260 and 261 also serve the additional function, as illustrated in FIG. 8 of spacing and supporting the separate side plates 262 and 264 forming the outer walls of the roller support subassembly. As shown in FIG. 10, at least one of the lead screw may be provided with a crank handle 266 which when rotated will cause the corresponding rotation of lead screws 176 and 178 to urge roller support subassemblies 180 and 181 toward or away from the head central framework 170 to thereby vary the spacing between the two pairs of rollers. A guide block 184 fixed at the end of central support 170 rides in a vertically extending guide channel or track 186 to stabilize the head assembly by preventing lateral movement and pivoting about support and guide post 110.

A pair of spaced apart force applying heads or rollers 188 and 189 are mounted on roller support roller subassembly 180, and additional rollers 190 and 191 carried on roller support subassembly 181. The roller support subassemblies, the rollers carried thereon and the driving mechanisms therefor are identical in construction and operate in a similar manner, although at different speeds. Accordingly, only one set of rollers and its roller support subassembly will be described in detail.

Roller support subassembly 180 has a top frame including a pair of spaced side plates 262 and 264 joined by a top plate 263 (FIGS. 8 and 10). Referring to FIG. 8, the non-threaded portions of shafts 176 and 178 pass through bearinged apertures in side plate 262 and the threaded ends are received in threaded bushings 258 in the opposite side plate 264. Roller support 180 is thereby movably supported. Top roller 188 is mounted on this top frame.

A movable frame 234, comprised of a pair of spaced side plates, is mounted between plates 262 and 264 (FIG. 10), although it is not connected directly to plates 262 and 264. Rather, it is supported on a four bar linkage 244 shown in FIG. 10. Bottom roller 189 is mounted to movable frame 234.

Figure 9:
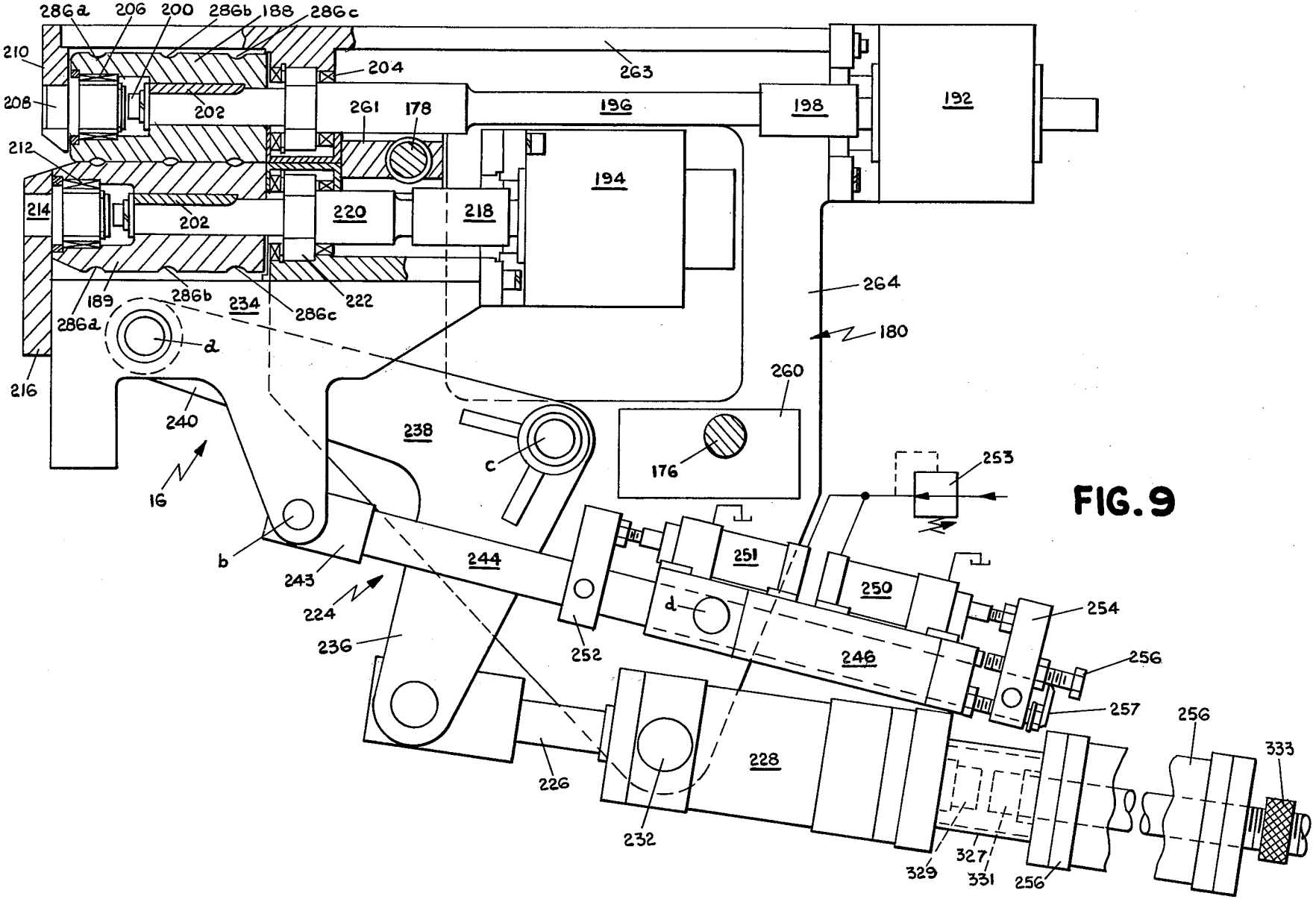
FIG. 9 is a side view of the elongating or forming head assembly partially in cross section and with portions removed for clarity.

The rollers are mounted for rotation within the subassembly and are driven by means of hydraulic motor 192 and electro hydraulic stepper motor 194 mounted to the rear of subassembly 180 (FIG. 9). Motor 192 is operably connected to drive roller 188 by means of an elongated shaft 196 and a coupling 198. Shaft 196 extends through roller 188 where it is fastened by conventional fastening means as a screw and lock washer 200. Additionally, shaft 196 is fixed as by a key 202 to the inner portion of roller 188. Shaft 196 is supported in bearing 204 fixed within the subassembly in a conventional manner. The outermost end of roller 188 is supported in a second set of bearings 206 which support roller 188 and rotate about a spindle 208 forwardly from the roller and retained in a leg 210 depending downwardly from the upper portion 263 of roller support subassembly 180.

Lower roller 189 is supported on lower movable frame 234 by a forward bearing 212 which rotates about a spindle 214 carried in an upwardly extending leg 216 mounted to the spaced plates of frame 234. Roller 189 is driven by the previously mentioned electro hydraulic stepper motor 194 mounted at the rear of frame 234 which is connected to the roller by means of coupling 218 and shaft 220 passing through bearings 222.

Movable frame 234 and its roller 189 and the drive means therefor including electro hydraulic stepper motor 194, are movably mounted within the framework and with respect to roller 188 by means of a four bar linkage system generally designated by the numeral 224 such that rollers 188 and 189 may be separated from each other to allow insertion of the circumferential wires of the welded reinforcing cage therebetween. The four bar linkage mechanism 224 is operated by the extendible and retractable piston rod 226 of a hydraulic cylinder 228. As shown in FIG. 9, cylinder 228 is pivotally fixed relative to roller support subassembly 180 to a downwardly depending portion of side plate 262 and 264 by means of trunnions 232 such that limited pivotal movement can occur with operation of the four bar linkage system. The linkage system is pivoted at four points or axles, two of which designated "*a*" and "*b*", respectively, are connected to the movable frame 234 which forms the support for lower roller 189. The remaining two pivot axles designated as "*c*" and "*d*" are located on the fixed (against pivoting) plates 262 and 264. A generally L-shaped bellcrank 238 is pivotally mounted on acle *c* to plates 262 and 264. A downwardly extending leg 236 of bellcrank 238 is connected to piston rod 226 and a forwardly extending leg 240 is pivoted on axle *a* to pivoting frame 234. A connecting rod 244 extends from axle *b* on a downwardly extending appendage of frame 234 and is telescopically received in a sleeve block 246 which in turn is pivoted on axle *d* of plates 262 and 264. The effective length of connecting rod 244 may therefore be varied. Sleeve block 246 includes a pair of oppositely directed biasing cylinders 250 and 251 mounted thereon. Collars 252 and 254 are fixedly mounted on connecting rod 244 and are engaged by the rods of pistons 251 and 252, respectively to provide a means of adjusting the angle between the centerlines of the two rollers 188 and 189 and provide compensation for the number of circumferential wires which are to be stretched between the roller assemblies. Note that there may be one, two or three wires in the bell mouth produced by the roller head assembly.

Adjusting the pressure setting on a progressive regulator 253 has the effect of moving to the left or to the right the location of the reaction force acting up from roller 189 against the material being stretched. The effective length of link 244 between points *b* and *d* can be varied by adjusting screws 256 and 257 on collar 254.

Upon retraction of piston rod 226 into cylinder 228, the four bar linkage assembly will cause the movable portion 234 of subassembly 180 to move downwardly in a level attitude thereby separating rollers 188 and 189 allowing the introduction of the circumferential wire or wires at the end of a cage therebetween as will be hereinafter described.

Cylinder 228 is hydraulically operated to develop the high pressures necessary between rollers 188 and 189. A second cylinder 256 carried in series with cylinder 228 is pneumatically operated to hold the rollers in position when cylinder 228 is deenergized. Operation by pneumatic cylinder is effected during case truing and wire trimming operations since at this time the roller assemblies are used to rotate the cage and operator with the truing assembly 24 to be discussed hereinafter. Considerably less force is required because wire elongating operations are not taking place.

HEATING AND COOLING ASSEMBLY

The heating or burner assembly 268 and its attendant cooling nozzle 270 are described separately, even though they do in the broadest sense constitute important parts of the forming assembly.

Figure 11:
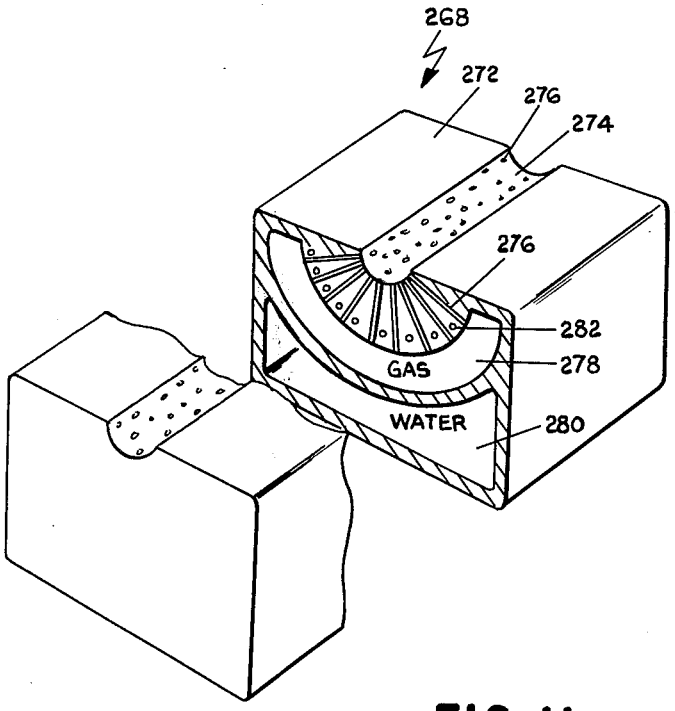
FIG. 11 is a perspective view of a portion of the burner assembly for applying heat along a localized zone of the wire during stretching.

The burner assembly 268 shown in FIG. 11 provides the means by which an intense concentrated source of heat is directed along the wire during elongating operations. For a three strand bell, there might be three such heating units arranged adjacent one another. Upper surface 272 is provided with an elongated channel 274 extending along its length. Channel 274 has a plurality of openings therethrough 276 which extend into the generally hollow center of the head assembly 268. Gas is introduced into a first or inner chamber 278 in a conventional manner where it passes through drilled orifices 276 to exit in channel 274. To prevent overheating of the heat source, a secondary chamber 280 is provided for the flow of cooling water. Similarly, a plurality of elongated 282 extending along the length of the heat source between the gas chamber 278 and channel 274 provide additional cooling with water to prevent overheating of the upper channel surface. Preferably, a high energy fuel sufficient to raise the temperature of the wire to approximately 2000°F. is utilized. One suitable fuel is commonly commercially available under the trade name Mapp Gas which is a hydrocarbon gas used in conjunction with oxygen. It will, of course, be realized that other burner assemblies and high BTU output gas can be utilized with equal facility, as for example, a vortex-type burner.

Burner 268 must be capable of supplying sufficient heat to heat strands of steel wire having diameters of from 1/16 to 9/16 inch to a temperature sufficiently high to allow substantial elongation as a result of the force which can practically be generated between the two sets of rollers 180 and 181 when the wire is moving past the heater at speeds of from 25 to 40 feet per minute. The wire diameters are typical of those used in reinforcing fabric and the speeds listed are simply desirable production rates. Lesser heat sources could be used if one were satisfied with lower speeds.

It has been found that it is desirable to heat the wire to temperatures of 2000°F. and up, although lower temperatures may work. The elongation required is typically in the range of from 10% to 60%. Additional information on temperatures and elongations, and on some totally unexpected and desirable results which can be obtained under proper circumstances, i.e., the fact that the wire can be substantially strengthened by this process, are set forth in our copending application Ser. No. 542,341, filed on even date herewith, entitled METHOD AND APPARATUS FOR PRODUCING HIGH TENSILE STEEL FROM LOW AND MEDIUM CARBON STEEL, which application is specifically incorporated herein by reference.

The coolant nozzle 270 is adapted to direct a spray of cooling water onto the wire after it is passed through the burner assembly and just prior to its entrance into the downstream rollers. The wire should be quickly cooled to a point at which it cannot be further elongated by the force between the rollers so that elongation is controlled and located between the heating means 268 and the quench. Conventional water drain off means can be provided to take care of used water. Several nozzles may be employed, and at least one for each bell strand is desirable.

Figure 12:
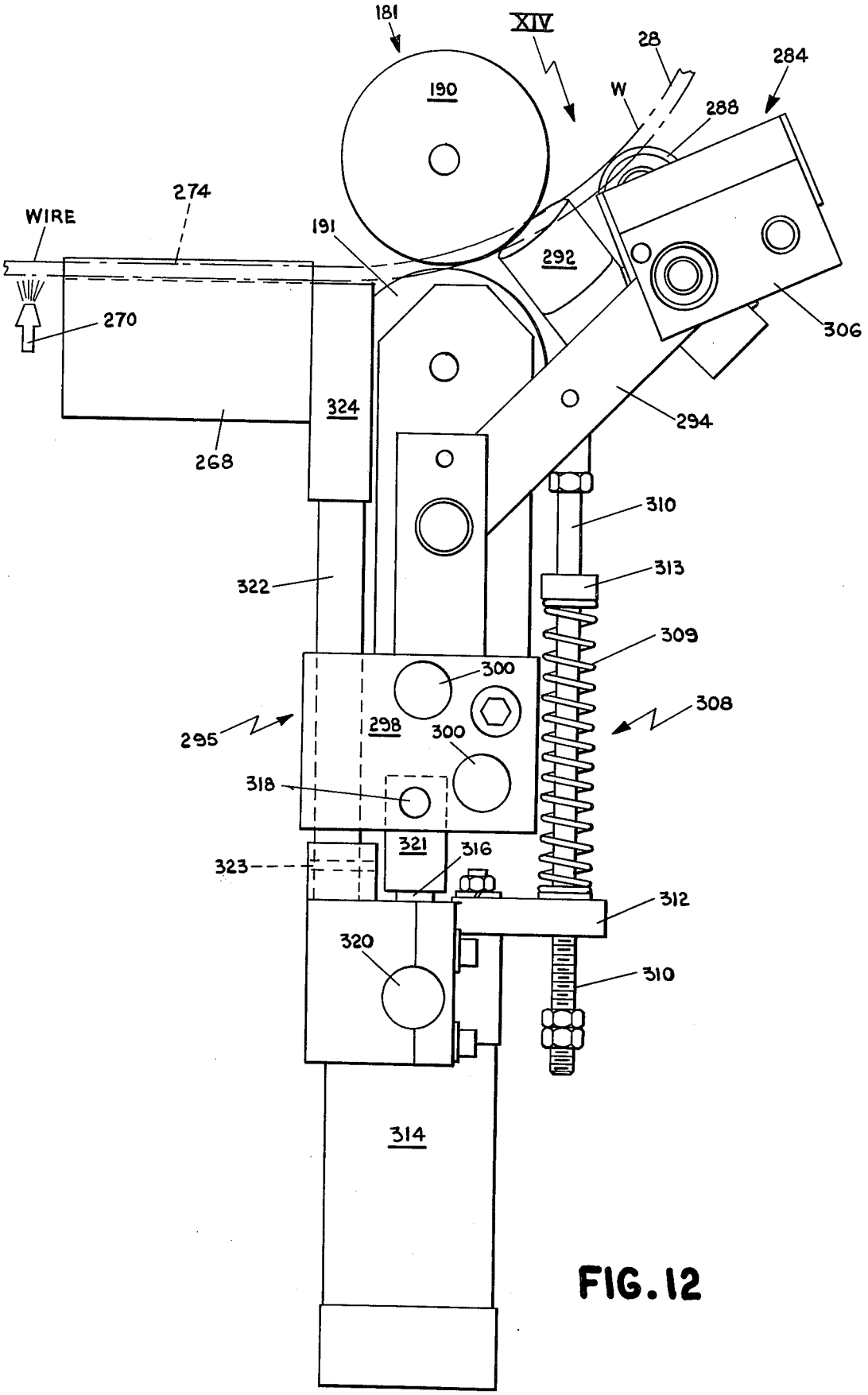
FIG. 12 is a fragmentary view of the heater support and wire guide positioned at the upstream end of the head assembly.
Figure 13:
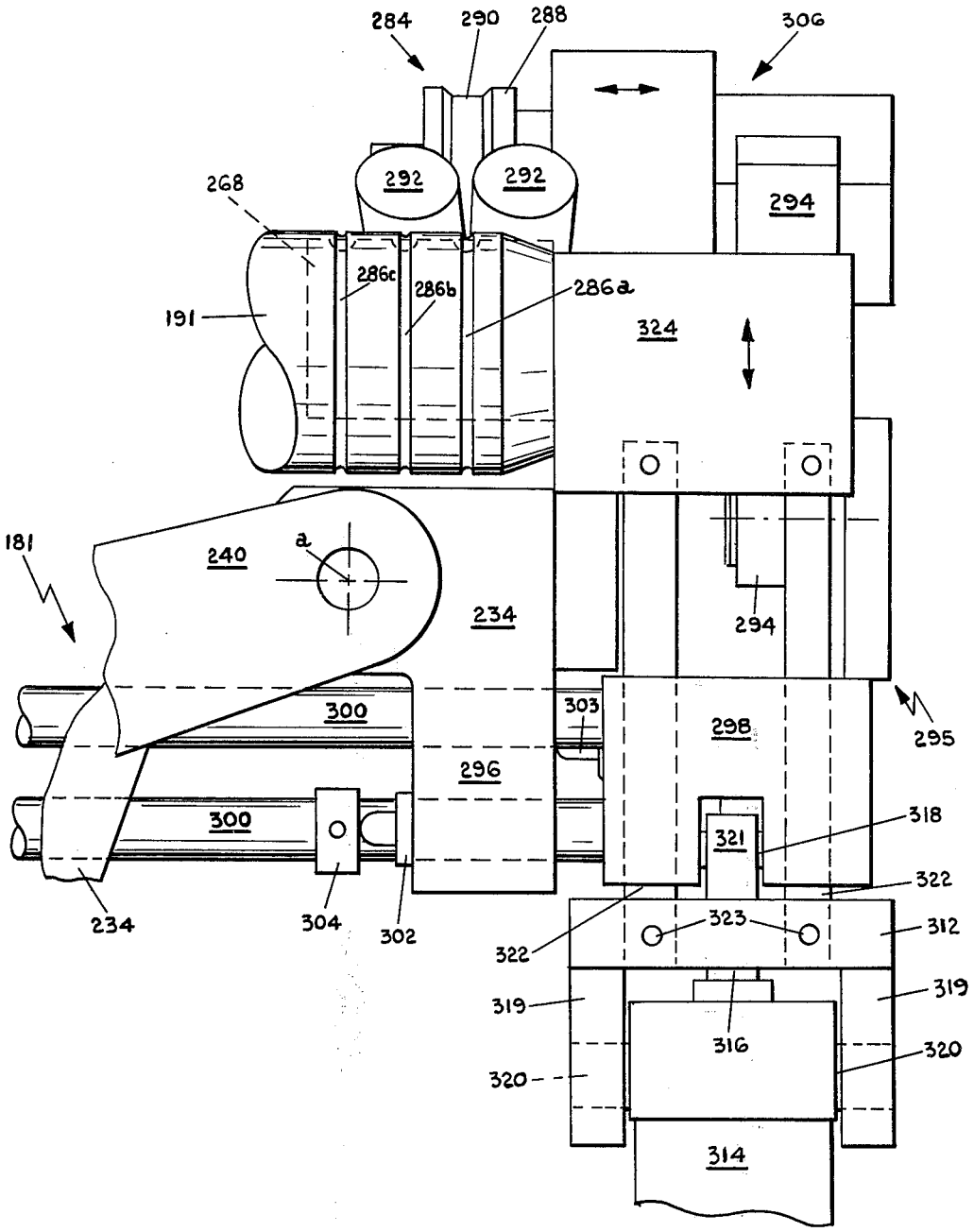
FIG. 13 is a fragmented side view of the wire guiding mechanism shown in FIG. 12.

Burner 268 and cooling nozzles 270 are mounted and supported on a plate 324 which is part of a movable assembly 295 (FIG. 12). Movable assembly 295 is slidably mounted on a forwardly facing and downwardly depending flange 296 located at the front of movable portion 234 of roller support subassembly 181 (FIG. 13). The purpose of this mounting is to keep burner 268 and cooling nozzles 270 properly aligned with circumferential bell strands being elongated. Such alignment is controlled by wire guiding assembly 284 which is described below in conjunction with movable assembly 295.

BURNER GUIDING MECHANISM

Guide means 284 are provided at the entrance to the upstream rollers to insure that the burner properly tracks the circumferential wires of the bell mouth. The groove 286*a* formed in the lower rollers 191 and 189 (FIGS. 13 and 9), tracks the inside circumferential wire of the bell mouth. Additional grooves 286*b* and 286*c* provide for the second and third wires should they be present in the bell mouth. The guide assembly is positioned at the entrance to the upstream roller assembly 181 and directs the wire between rollers 190 and 191 and into groove 286*a*.

Figure 14:
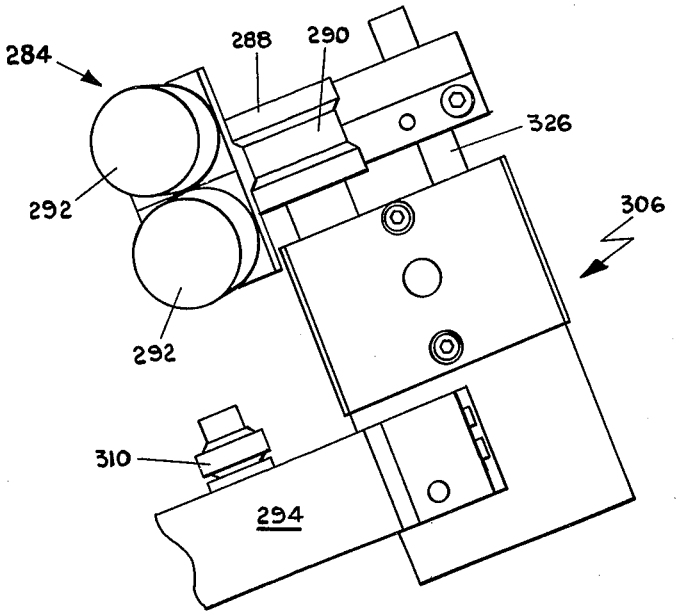
FIG. 14 is a partial view of the wire guide as viewed along the arrow XIV of FIG. 12.
Figure 16:
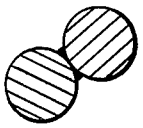
FIG. 16 is a cross-sectional view taken along the plane XVI—XVI of FIG. 15.
Figure 15:
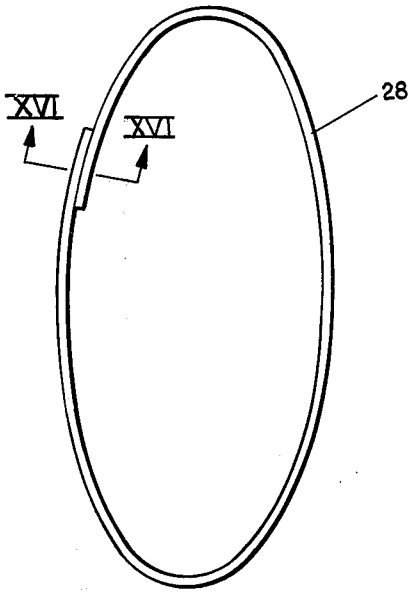
FIG. 15 is a perspective illustration of one of the circumferential wires operated on by the invention.

The wire guiding assembly 184 is needed primarily to accommodate the welded ends of the circumferential wires on the formed cage. This is illustrated somewhat schematically in FIGS. 15 and 16 wherein it is seen that the wire ends overlap at their welded portion and accordingly in effect constitute a spiral. Consequently, for the groove of the burners to remain centered around the circumferential wires to be heated, since the cage is not imparted any axial movement (or oscillation) the burner must be made to follow the wire. Wire guide assembly 284 includes first a guide wheel 288 having a circumferential groove 290 formed thereabout and adapted to receive the wire at its entrance to the upstream roller subassembly 181 (FIGS. 13 and 14). A pair of idler rollers 292 are positioned to rotate about an axis generally perpendicular to the axis of rotation of guide wheel 288. Idler rollers 292 are angularly disposed with respect to each other to form a V-shape or groove to guide the wire between rollers 190 and 191 and into the groove 286 formed thereon.

Guide wheel 288 and rollers 292 are mounted for movement in response to the position of the wire and to follow the wire.

Rollers 292 and guide wheel 288 are pivotally mounted at the end of an arm 294 which in turn is supported on movable assembly 295 (FIG. 12 particularly, and FIG. 13). Movable assembly 295 includes a first mounting block 298 having a pair of horizontally extending guide rods 300 extending from one side thereof and slidably received in flange 296 (FIG. 13). Guide rods 300 allow axial shifting of movable assembly 295 as required during operation. The mounting assembly is normally biased into a generally central position by a pair of spring loaded biasing members 302 and 303. Biasing member 302 operates on a counter 304 fixed on the lower guide rod 300 while biasing member 303 fixed in mounting block 298 extends outwardly and into engagement with flange 296. The two biasing members 302 and 303 cooperatively maintain the movable assembly in a position yet, at the same time, allow movement to the left or right with respect to flange 296 as required and sensed by the guide assembly 284 as will be hereinafter described.

The pivoted arm 294 is carried on mounting block 298 for movement therewith (FIGS. 12 and 13). The opposite end of arm 294 has a housing 306 mounted thereon which also supports guide wheel 288 and idler rollers 292. The arm and housing 306 are biased upwardly into an operative position by biasing assembly 308. Biasing assembly 308 includes a spring 309 operable on a rod 310 fixed at one end to the mid-portion of arm 294. The opposite end of rod 310 is slidably retained in a mounting flange 312. A collar 313 fixed upon rod 310 retains spring 309 between collar 313 and the flange 312.

Actuator cylinder 314 having an extendible and retractable piston rod 316 is supported at one end of piston rod 316 to mounting block 298. Rod 316 is secured through clevis 321 in mounting block 298 in a conventional manner as by a pin 318. Mounting flange 312 is secured to the top of the cylinder 314 for movement therewith. The mounting flange 312 includes a pair of downwardly extending legs 319 which receive cylinder trunnions 320 located at the end cap of cyliner 314. A pair of spaced apart guide rod members 322 extend upwardly from flange 312 and are fixed at one end in mounting flange 324 and held therein by pins 323. Guide rods 322 extend upwardly and pass through machined openings through mounting block 298 where at their upper ends they support burner mounting plate 324. The previously described burner assembly 268 is fixed to mounting plate 324 to extend outwardly generally transversely to rollers 190 and 191 and in alignment with the grooves 286 formed in the rollers to thereby be in alignment with a wire passing through the apparatus.

Cylinder 314 retracts the burner assembly 268 and also guide assembly 284 after stretching cycle is completed. As piston rod 316 is retracted the relatively fixed mounting block 298 remains stationary and cylinder 314 is urged upwardly simultaneously moving guide rod 322 and a burner mounting plate 324 so located therewith upwardly to thereby move burners 268 into position. Simultaneously, biasing assembly 308 is operated with depression of spring 309 against collar 313 to thereby urge arm 294 and the wire guide assembly controlled thereby upwardly into its operative position as shown in FIG. 12. It will, of course, be realized that as piston rod 316 is extended cylinder 314 will move downwardly thereby simultaneously moving burner assemblies 268 and wire guide assembly 284 downwardly and away from operative position. Cylinder 314 is operated in a timed sequence with cylinder 228 previously described in connection with the movable portion of the roller assemblies such that as rollers 190 and 191 are moved away from each other to receive a wire cage, the heat source and wire guide assembly are also simultaneously moved downwardly.

Referring briefly to FIG. 14, the wire is directed over guide wheel 288 and between idler rollers 292. Idlers 292 are biased relative to each other such that whenever they are forced open by a lap of welded wire, the relationship of the assembly 306 remains the same with respect to the centerline of the lapped wires as it was to the centerline of the single wire.

Corresponding movements of cylinder 314 and the components associated therewith including the burner mounting plate 294 and the burner assembly 268 cause th burner assembly to move into the proper position to follow the wire. After the double thickness of wire has passed through the rollers and burner assembly biasing members 302 and 303 shift the burner assembly to conform with the new location of the centerline of the single lapped wire.

ROLLER DRIVE ASSEMBLY

Figures 17, 17A:
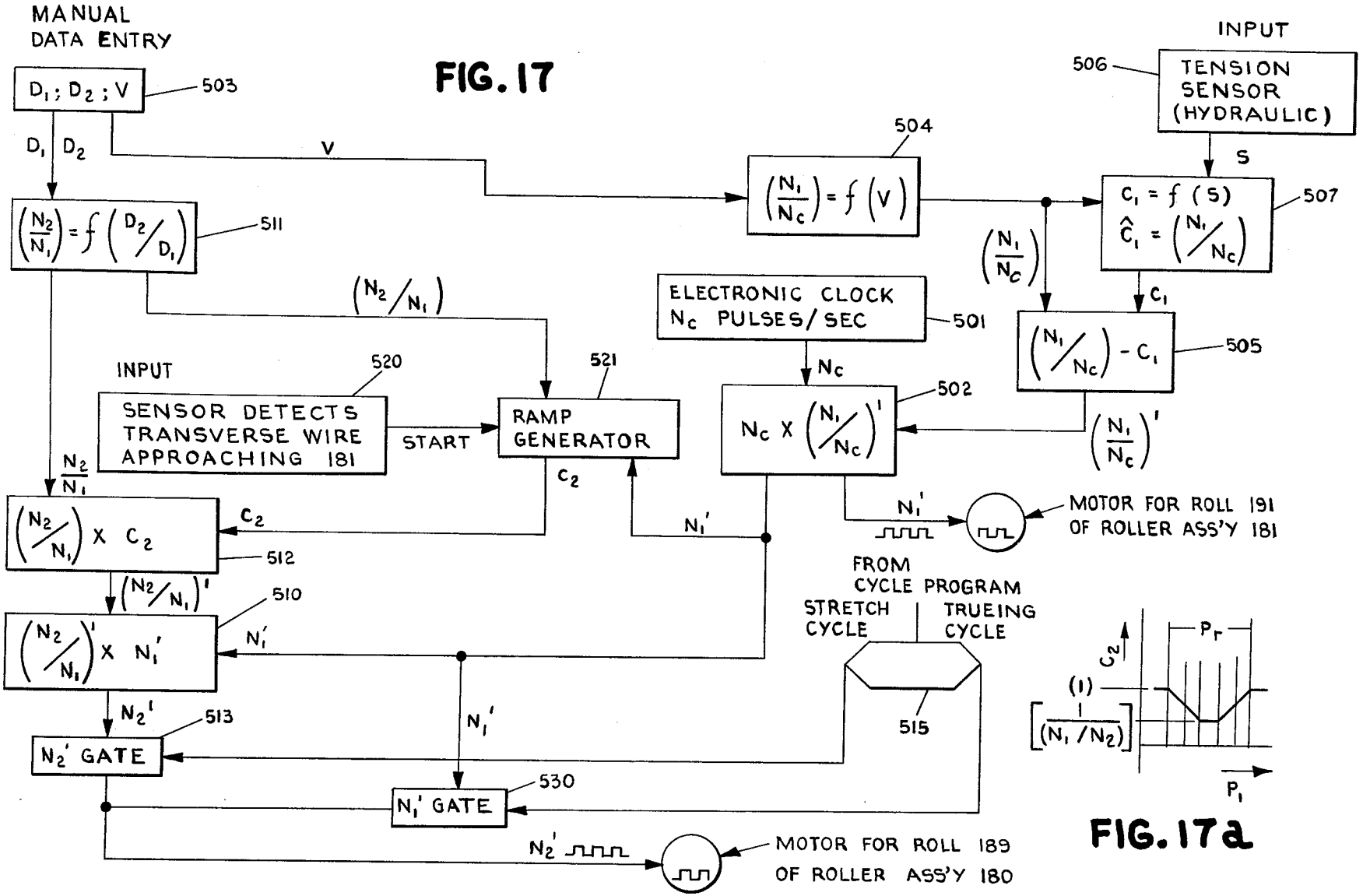
FIG. 17 is a simplified schematic diagram illustrating the drive mechanism for the forming rollers.
FIG. 17*a* is a chart illustrating the correction factor for the drive of the upstream forming rollers.
Figure 25:
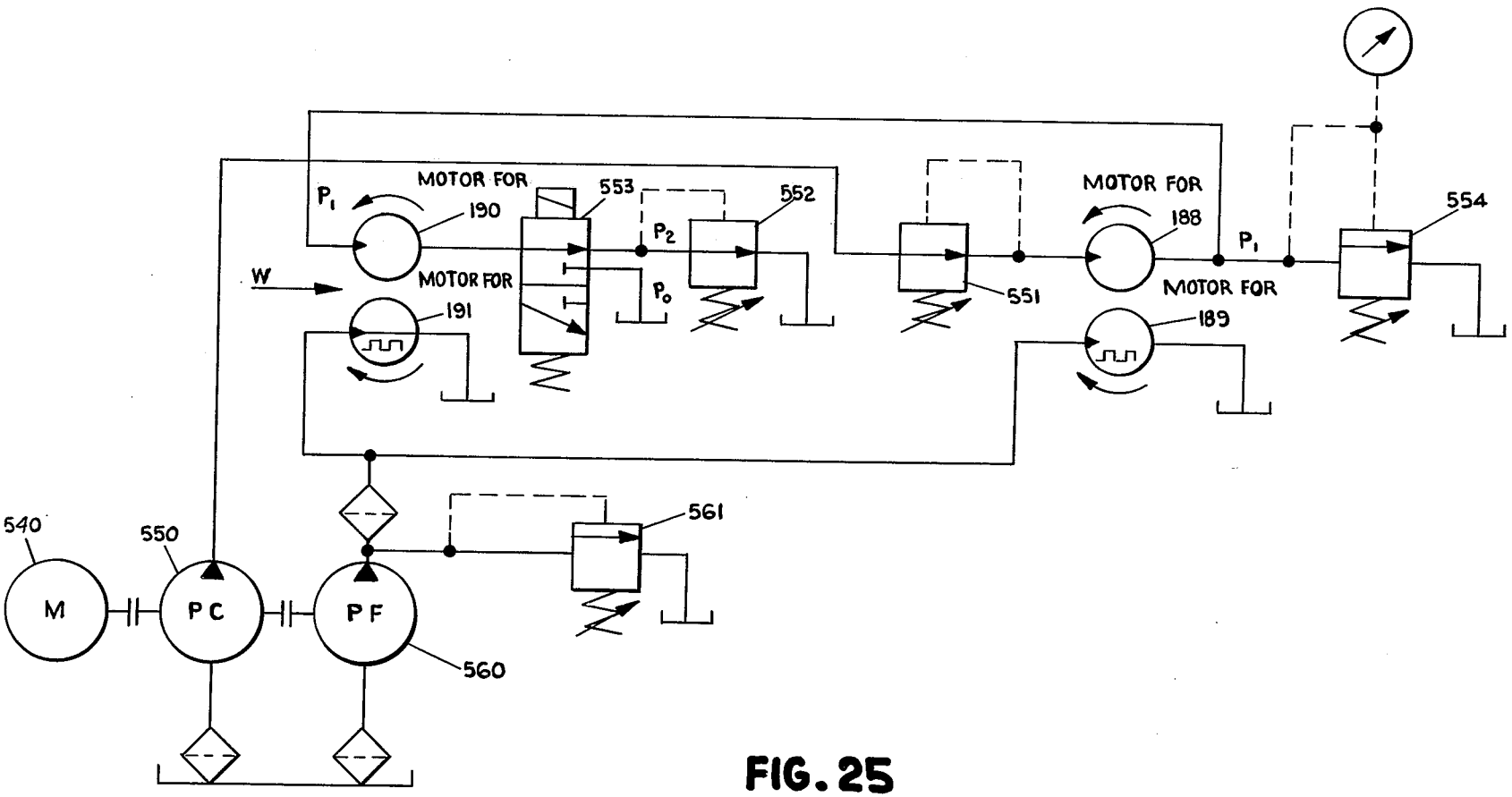
FIG. 25 is a simplified schematic illustration of the hydraulic mechanisms for controlling the tension on the wire during elongation thereof.

The roller drive assembly for driving the forming rollers of roller subassemblies 181 and 180 is divided into two parts. An electronic drive control system, as shown in FIG. 17, is used to drive the motors for the bottom rollers 191 and 189 of the subassemblies 181 and 180, respectively. A hydraulic control system shown in FIG. 25 is used for controlling the top rollers 188 and 190. The motors for bottom rollers 189 and 191 are electronically controlled and, thus, shown in FIG. 17 and they are hydraulically driven in response to that control and, thus, are also shown in FIG. 25.

Figure 26:
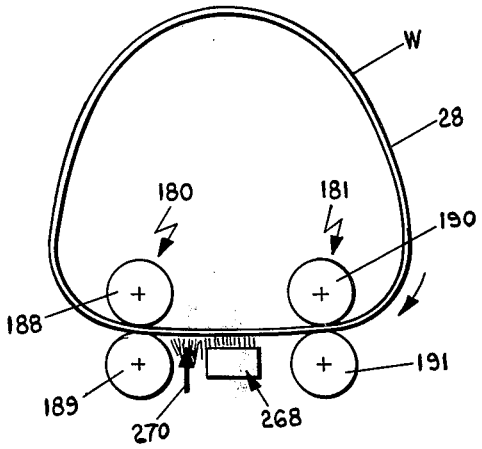
FIG. 26 is a simplified schematic illustration of the wire forming operation of the invention.
Figure 18:
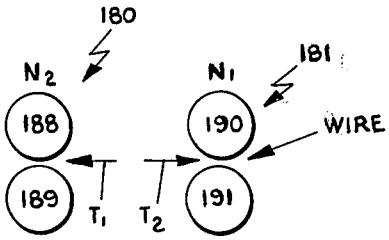
FIG. 18 is a schematic diagram illustrating some of the wire elongating parameters encountered during bell end forming.

Referring to FIG. 17, the electronic control system shown therein serves to drive the bottom rollers 191 and 189 at two different speeds during the stretch cycle of the apparatus and, at the same speed, during the truing cycle. It also serves to control the overall velocity of the circumferential wires 28 as they are rotated through the roller subassemblies in order to insure that the heating means 268 has sufficient time to heat each section of wire 28 to a temperature at which its yield point will allow for ready elongation between the roller subassemblies 180 and 181. Finally, the electronic control system of FIG. 17 insures that bottom roller 189 of roller subassembly 180 will reduce its speed a controlled amount as a transverse wire 26 passes through upstream roller subassembly 181. In describing the electronic control system, both FIGS. 26 which schematically shows the cage being rolled through the roller subassemblies 181 and 180 during the stretch cycle and FIG. 17 which shows the electronic control will be referred to. The motor for roll 191 of upstream roller assembly 181 is controlled in accordance with electric pulses $N_c$ received from an electronic clock 501 (FIG. 17). A multiplier circuit 502 selects certain of the pulses $N_C$ as a function of the desired velocity with which circumferential wires 28 are to be moved through the roller subassemblies 181. The desired velocity V is entered into the data entry section 503 and is transmitted to the logic circuit 504 for determining the ratio of $N_1$, the pulse rate which is desired to control the motor for roller 191 to the pulse rate $N_C$ emitted by the electronic clock 501. A signal $N_1/N_C$ is transmitted to tension correction circuit 505 which corrects the ratio to yield an $N_1N\ C'$ which, in turn, is fed into the multiplier circuit 502. In the multiplier circuit 502, $N_C$ is multiplied by $N_1/N_C'$ and the resulting pulse rate $N_1'$ emitted by multiplier circuit 502 is used to control the stepper motor of an electrohydraulic stepper motor assembly for driving roll 191 of roller assembly 181. Such electro hydraulic stepper motor assemblies are conventional and are described in conjunction with the aforesaid co-pending application entitled METHOD AND APPARATUS FOR PRODUCING HIGH TENSILE STEEL FROM LOW AND MEDIUM CARBON STEEL.

The desired velocity for roll 191, expressed as the ratio $N_1/N_C$, is corrected to compensate for the tension sensed by tension sensor 506 operably connected between bottom rollers 191 and 189 (FIG. 17). Data as to the tension sensed by tension sensor 506 is fed into logic circuit 507 which determines a correction factor $C_1$ as a function of tension, S. The maximum which the correction factor can be, i.e., $C_1$ equals $N_1$ over $N_C$. Logic circuit 507 knows what $N_1/N_C$ is since it receives this information from logic circuit 504. When the circumferential wires 28 are first positioned in the roller subassemblies 181 and 180, prior to ignition of burner 268, this maximum tension condition will exist and the correction factor will equal $N_1/N_C$. This correction factor $C_1$ is fed to the correction logic circuit 505 and is subtracted from $N_1/N_C$. Thus, at the outset of operation, the electronic pulses $N_1'$ fed to the motor of the roller 191 will be zero and there will be no movement of the circumferential wires 28. As heating means 268 heats up the wire, the tension sensed by sensor 506 will begin to be decreased and the value of correction factor $C_1$ will gradually decrease to zero. As a result, the pulse rate $N_1'$ will increase and the motor of the roller 191 will smoothely accelerate the circumferential wires 28 through the apparatus to the selected speed V.

A similar electro hydraulic stepper motor assembly for roller 189 is driven as a function of the pulse rate $N_1'$ for controlling roller 191. The pulse signal $N_1'$ is fed to a multiplier circuit 510 for multiplying a corrected ratio of $N_2/N_1'$ by $N_1'$ to thereby obtain a value $N_2'$ used to control the rotation of roller 189. The ratio $N_2/N_1$ is determined as a function of the final bell mouth diameter $D_2$ and the initial or starting cage diameter $D_1$. Information as to the starting, $D_1$, and final desired bell mouth diameter $D_2$ is fed into the data entry unit 503 and from thence is fed to the logic circuit 511 for determining $N_2/N_1$ as a function thereof. The resulting $N_2/N_1$ signal is fed to a correction circuit 512 which corrects the ratio as a function of the necessity of the roller 190 of subassembly 181 to walk over transverse wires 26 and thereby momentarily increase the tension in the circumferential wires 28 between subassemblies 181 and 180. The corrected ratio, $N_2/N_1'$, is fed to the multiplier circuit 510 for multiplication by $N_1'$ to yield a pulse rate signal $N_2'$ for controlling motor 189.

However, pulse rate $N_2'$ is first fed to $N_2'$ gate 513 which may or may not allow the signal $N_2'$ to be delivered to the motor for roll 189. This is determined by the system programmer 515. If programmer 515 indicates that the apparatus is in its stretch cycle, the signal so indicating is fed to the base of $N_2'$ gate 513 and the gate is opened, thereby allowing the pulse signal $N_2'$ to reach the motor for roll 189 and to drive it at a rate $N_2'$ which will normally be an amount greater than $N_1'$ which is a function of the desired change in bell mouth diameter as expressed by the ratio $D_2/D_1$.

The correction of the ratio $N_2/N_1$ by the correction factor $C_2$ in the multiplier correction circuit 512 is for the purpose of causing the roller 189 to slow down to approximately the speed of bottom roller 191 as the top roller 190 of upstream roller subassembly 181 walks over a particular transverse wire 26. If the downstream drive roller 189 did not slow down, it would unduly elongate the wire 28 and, perhaps, even break it due to the increased tension as roller 181 walks over a transverse wire 26. Thus, a wire sensor 520 (FIGS. 17 and 26) senses an approaching transverse wire 26 and tells roller 189 to start slowing down. The wire sensor 520 sends a starting signal to a ramp generator 521. The ramp generator 521 has two inputs. One is the ratio $N_2/N_1$ from multiplier circuit 511 and the other is the pulse signal $N_1'$ used to drive roll 191, received from multiplier circuit 502. Referring to FIG. 17*a*, it can be seen that the purpose of the input $N_2/N_1$ is to determine the amplitude of the ramp generated by ramp generator 521. The correction factor $C_2$ is displayed on the ordinate of FIG. 17*a*. At the outset, the value of $C_2$ is 1. The signal gradually decreases to a value of 1 over $N_1/N_2$ and then proceeds back up again to its starting value of 1. It can be seen that when the value of $C_2$ is 1 over $N_1/N_2$, the corrected drive ratio $N_2/N_1'$ will be 1 and the value of $N_2'$ as determined by multiplier circuit 510 will equal $N_1'$, resulting in roll 189 being driven at the same speed or rate of rotation as roller 191.

The purpose of feeding the pulse rate $N_1'$ into ramp generator 521 is to control the pitch or width of the ramp generated. The pulse rate $N_1'$ is directly proportional to the rate of travel of the circumferential wires relative to the critical roller 190 (from standpoint of transverse wires impacting against it). Hence, utilizing pulse rate $N_1'$ is a variable such that $C_2$ is a function of $N_1'$ locks in the slowest speed of 189 to the same linear location along the circumferential wires relative to the point at which the transverse wire was initially detected by sensor 520. This relationship remains true regardless of substantial changes in speed V which may be brought about either due to data entry or because of the action of self compensating controls built into the control system. Referring to FIG. 17*a*, it takes the ramp a particular number $P_r$ of pulses P to be generated. The pulses P are derived from $N_1'$. The faster the pulses are generated in accordance with rate $N_1'$, the less time it will take the ramp as viewed in FIG. 17*a* to be generated. The slower the pulses $N_1'$ are generated, the longer it will take the ramp to be generated. Thus, the rate at which roller 189 slows down and speeds up again is a function of the rate at which the upstream roller 190 will walk over a particular transverse wire 28.

During operation of the truing cycle, it is, of course, desirable to drive the downstream roll 189 at precisely the same rate of rotation as the upstream roll 191 so that there will be no tension therebetween. During the truing cycle, both rolls 191 and 189 simply serve as drive rolls and means for rotating the cage past the truing rollers. To achieve this result, the pulse rate signal $N_1'$ is fed to an $N_1'$ gate 530, $N_1'$ gate is opened or closed by programmer 515. If the programmer 515 indicates that the system is in its truing cycle, gate 530 is opened, gate 513 is closed and the signal $N_1'$ is fed directly to the motor for roll 189. On the other hand, when the stretch cycle is operative, gate 530 is closed and the signal $N_1'$ does not get through gate 530.

The hydraulic control circuit (FIG. 25) for driving and controlling the motors for top rolls 188 and 190 serve to drive those rolls in such a way that they assist the bottom drive rolls 189 and 191. In essence, while they will not drive the wire 28 by themselves, they provide a continuous traction to circumferential wires so that they in essence, assist rollers to bottom drive rolls. A motor 540 drives a pressure compensated pump 550 which pumps fluid through a pressure regulator valve 551. From thence, the hydraulic fluid is fed to the hydraulic motor the roll 188. Roll 188 is the upper roller of the downstream roller subassembly 180. Pressure regulator valve 551 is adjusted so that the pressure delivered to the motor for roll 188 is just enough to cause roll 188 to apply a pull or traction to wire 28 which is just below the "skid value" for the roller 188. In other words, it is desirable to apply maximum pull to wire 28 without having roll 188 skid on the surface of wires 28.

From the hydraulic motor for roll 188, the fluid is fed to the hydraulic motor for roll 190. Roll 190 is the upstream upper roll and because during the wire stretching operation it acts as a pump, it serves as a drag. The magnitude of this drag is a function of the difference in pressures $P_1$ and $P_2$. The pressure $P_1$ is established by the setting of the relief valve 554. The pressure $P_2$ is determined by the setting of the relief valve 552. These settings are made to produce a resisting torque in the drag just below the point at which roll 190 would begin skidding on circumferential wires 28. A three-way solenoid valve 553 is provided between the motor for roll 190 and relief valve 552 such that during the truing cycle, valve 553 can be shifted and the fluid from motor 190 will flow directly to the reservoir. In this way, the motor for roll 190 will not exert any drag force during the truing operation, but will actually produce a positive pull assisting the other motors in truing the cage. It will simply be driven by the hydraulic fluid at the same speed as the motor for roll 188. A pressure relief valve 554 is provided downstream of the motor for roll 188 and parallel to the line going to the motor for roll 190 so that a constant pressure of fluid travels to the motor for roll 190.

The motors for rolls 191 and 189 are supplied by a fixed pressure pump 560 and are conventional electro hydraulic stepper motors. A pressure relief valve 561 and appropriate filters are provided. This hydraulic drive section is, of course, controlled by the electro stepper motor portion of the electro hydraulic stepper motor assembly.

ANALOG ASSEMBLY

Just as different diameter cages require that rollers **20, 20*a* and 30 assume different operating positions, so too the roller sets 180 and 181 must assume different positions for different diameter cages. The relationship between the vertical position of forming assembly 16 and the position of the support or chucking rollers 20, 20*a* and 30 is controlled by a mechanical analog assembly 344 illustrated in FIGS. 19, 20 and 21. In the analog assembly, two separate inputs (346 and 348) are integrated to operate the pilot regulator valve 352 which in turn controls cylinder 118 and thereby the height of forming assembly 16 (FIG. 1**).

Two separate inputs are required because the relationship between the position of rollers **20, 20*a* and 30 is not a linear function of cage size. For larger cages, the relationship does tend to approach linear. For smaller and smaller cages, however, the former 16 has to go higher relative to rollers 20, 20*a* and 30 in order to allow the top rollers 190 and 188 of roller sets 181 and 180** to get inside the cage.

The analog is contained within a housing having provision for a first or rotary input at a sprocket wheel 346. Sprocket 346 is driven by means of a chain drive (not shown) which is connected in a conventional manner to splined shaft 58. Rotation of sprocket 346 is accordingly proportional to the rotation of the splined shaft which, as it will be recalled, controls the movement of support roller assemblies **19, 19*a* and 29.** Such rotation therefor can be used to determine the position of the support rollers and thus the determination of the position of the wire cage with respect to the centerline of the apparatus.

A second input to the analog is provided by means of a cam surface 348 attached to sleeve 112 (see FIG. 7) which moves vertically with movement of former head assembly 16. A cam follower 350 engages cam surface 348 and is moved laterally with respect to the cam surface to provide a second input to the analog for controlling a pilot pressure regulator 352. Pressure regulator 352 in turn controls the air pressure applied to air cylinder 118 which controls the vertical position of forming head assembly 16.

Figures 19, 20, 21:
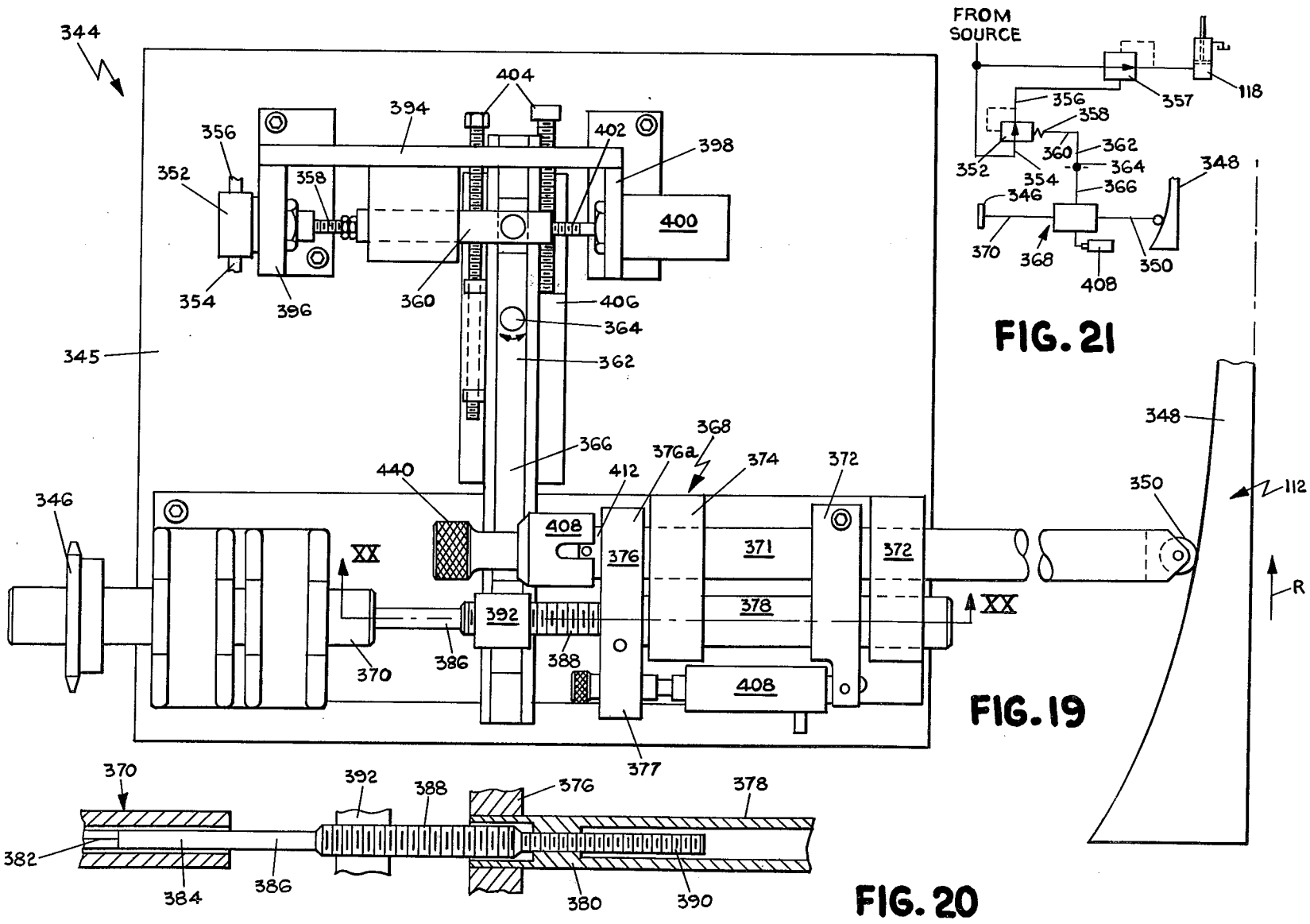
FIG. 19 is an elevation view of an analog system for controlling the height of the elongating or bell forming head assembly.
FIG. 20 is a partial cross-sectional view taken along the plane XX—XX of FIG. 19.
FIG. 21 is a schematic diagram illustrating the operation of the analog of FIG. 19.

Basically, analog 344 includes a pivoted linkage arrangement and an integrator to operate pilot pressure regulator 352. For clarity, the schematic view of FIG. 21 is shown to illustrate the principle of the basic operation of the analog. Reference numbers of FIG. 21 correspond to similar components in FIGS. 19 and 20. Pilot pressure regulator 352 shown therein is of conventional construction and includes pressure inlet port 354 and an outlet port 356 connected to operate a main regulator valve 357 connected between cylinder 118 and a pressure source (not shown) in a conventional manner. The pilot pressure regulator includes a shiftable means 358 for adjusting its pressure setting by changing the preload of its spring. The shiftable means 358 is operable by an arm member 360 which is mounted for operation at one end of a linking arm 362 pivotally mounted for movement about a pivot point 364. The lower end 366 of pivotal linking arm 362 is operatively connected to a mechanical integrator assembly 368 which receives a first rotary input from shaft 370 connected to sprocket 346 and rotatable in response to rotation of spline shaft 58 to provide an input related to the position of the support roller assemblies. The second input is the feedback provided from cam follower 350 in response to the position of the head as determined at cam surface 348. Rotary movement of shaft 370 and linear movement of cam follower 350 are mechanically integrated in integrator 368 to urge pivot arm 362 to pivot about point 364 and moving arm 360 to thus move shiftable means 358 to connect pilot pressure regulator 352 to control main valve 357 as required.

Mechanical integrator 368 is shown in greater detail in FIGS. 19 and 20. Cam follower 350 includes an elongated rod 371 which is slidably mounted in a pair of guide blocks 372 and 374 fixed within the integrator assembly. An arm 376 is fixed to sleeve 378 for movement therewith. One end **376*a* of arm 376 slidably receives rod 371 while the opposite end 377 is connected to the piston rod and through a cylinder 408 to a second arm 379 which is also fixed to rod 371. Hollow shaft or sleeve 378 is slidably received through second arm 379. Rod 371 and second arm 379 are thus movable together as are shaft 378 and arm 376. The two sections are connected together through cylinder 408. Sleeve member 378 has an internally threaded portion 380, (FIG. 20). Shaft 370 has a configured opening 382 therein, as a spline which slidably receives one end 384 of a shaft member 386 having a corresponding configuration such that it will rotate with rotation of shaft 370 and yet is axially movable with respect to shaft 370. Shaft 386 carries two threaded portions 388 and 390 each portion having a different pitch than the other portion. The first threaded portion 388 is larger in diameter and has a relatively large lead than the second threaded portion 390 which is of a lesser diameter. The first threaded portion 388 is threaded in a nut 392 mounted for movement with the lower end 366 of linking arm 362. The second threaded portion 390 is received in the internally threaded portion 380 of sleeve 378. Accordingly, rotation of sprocket 346 will cause corresponding movement of threaded shaft 386 causing, in a first direction of rotation, i.e., counterclockwise, threaded nut 392 to move to the right thereby pivoting arm 362 and increasing the pressure setting on pilot pressure regulator 352 to supply higher air pressure to cylinder 118. This, of course, will cause head assembly 16 to raise. As head assembly 16 raises, as shown by the arrow marked R, a feedback signal is provided at cam surface 348 and follower 350 since as rod 371 is moved to the left a nulling effect takes place by virtue of pivot arm 362 moving in the opposite direction thus reducing air pressure to cylinder 118. Shaft 386 is, of course, free to move as required because of spline end 384 moving into opening 382.**

Pilot pressure regulator 352 is supported on a frame member 394 having a pair of downwardly depending legs 396 and 398. Pilot pressure regulator 352 is supported in one leg 396 while the opposite leg 398 carries a biasing cylinder 400. Cylinder 400 includes a piston rod 402 which normally urges arm 360 to the left thereby maintaining cam follower 350 biased against the cam surface 348. Suitable adjustment means as screws 404 provided on frame member 394 are adjusted to contact an abutment member 406 which carries pivot 364 to adjust the point of rotation of arm 362 about point 364 to change the ratio of travel of member 360 to member 371 thereby enabling tuning for optimum performance.

Cylinder 408 is provided to offset the position of the forming head with respect to the centerline of the cage during truing operations. During wire forming operations when the circumferential wires are being elongated, it is desirable to allow forming head assembly 16 to move or float freely vertically on the support post 110. During forming, this allows the head 16 to move downwardly as required to compensate for the increasing diameter bell end. Toward this end, when forming begins, cylinder 408 (FIG. 19) in a first position maintains arms 376 and 379 relatively fixed with respect to each other. During truing operations, however, cylinder 408, in a second position, allows the head position, as sensed by cam follower 350 to offset with respect to the position of support rollers (provided at the input from sprocket 346). Means for adjusting the travel of arm 376 and the resulting amount of offset, in response to operation of cylinder 408 is provided in the form of a cap member 409 fixed at one end of cam follower shaft 371 and a knurled adjustment screw 410 operable to cooperatively vary the gap spacing 412 between cap 409 and arm 376.

CAGE TRUING APPARATUS

Figure 27:
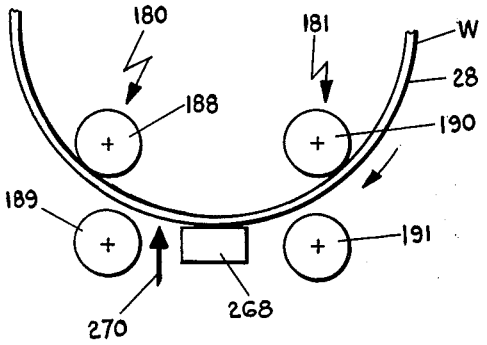
FIG. 27 is a simplified schematic illustration similar to FIG. 26 illustrating the position of the forming head in a cage receiving position.
Figure 22:
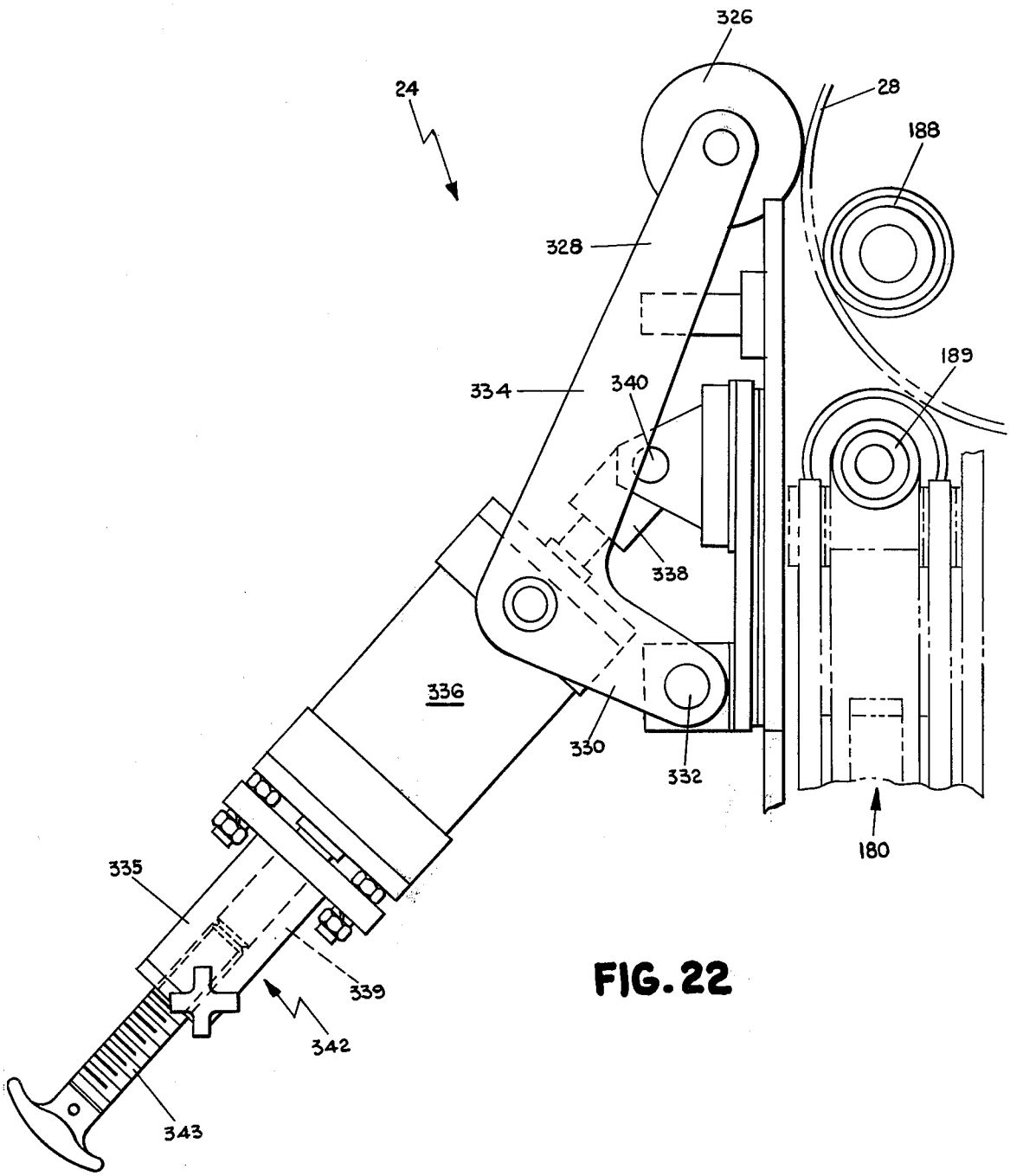
FIG. 22 is a fragmentary view of the truing roller assembly.

With reference to FIG. 27, the truing roller assembly 24 will be described in greater detail. The truing roller is operated after the stretching operations is completed and forming rollers 189 and 191 are retracted by operation of cylinder 228 causing the lower rollers to move away from the upper roller assemblies. At this time force is applied to the lower rollers by operation of air cylinder 256. Truing roller assembly 24 is positioned at the outlet side of the downstream rollers 188 and 189. Truing roller assembly 24 includes pressure roller 326 which engages the outer circumference of the circumferential wires 28 forming the bell end of the cage. Pressure roller 326 is rotatably attached to a pair of generally L-shaped arms 328. The lower leg 330 of the arm is pivoted at 332 to one side of the support framework 180 for the downstream roller assembly. The intersection of the lower leg 330 and the upper longer leg 334 of arm 328 is connected to an air cylinder 336. Cylinder 336 has an extendible and retractable piston rod 338 which is connected at its outermost end as indicated at 340 to the side of the support framework 180 at a point slightly above pivot point 332 to which the lower leg 330 of arm 328 is connected. Suitable adjustment means 342 is provided to control the extent of travel of piston rod 338 and the resultant movement of pressure roller 326 to provide a convenient means to adjust and compensate for wire cages of different diameters. Adjustment means 432 (FIG. 22) includes a threaded screw 343 received in a threaded housing 335 carried at the end of cylinder 336. One end 339 of piston rod 338 extends through the back of cylinder 336 and comes into abutting relationship with screw 343 to thereby limit the forward travel of cylinder 336 and as a result to control the position of pressure roller 326 with respect to the circumferential wire. As the cage is rotated by roller sets 180 and 181 (both operating at the same speed at this time) roller 326 acts against the bell to relieve any irregularities in its shape.

During truing operation, rollers 189 and 191 are brought into correct position necessary to achieve a true arc on the bell mouth by air cylinders 256 (FIG. 9).

Cylinder 256 as previously mentioned, takes over from the hydraulic cylinder 228. Air cylinder 256 is connected to the end of hydraulic cylinder 228 by a connector member 327. The end 329 of piston rod 226 of hydraulic cylinder 228 extends into connector 327 where it is operated on by the piston rod 331 of air cylinder 256. As air cylinder 256 is operated, its piston rod 331 operates against the end 329 of piston rod 226 to operate the linkage mechanism 224 as previously described. The opposite end of piston rod 331 extends through cylinder 256 and is equipped with an adjustable stop mechanism 33 by which the extent of travel of the piston rod is controlled. Since rollers 189 and 191 are operated by the air cylinder during truing, the air cylinder will act as a spring to allow passage of transverse wires between the rollers.

WIRE CUTTING AND TRIMMING APPARATUS

Figure 23:
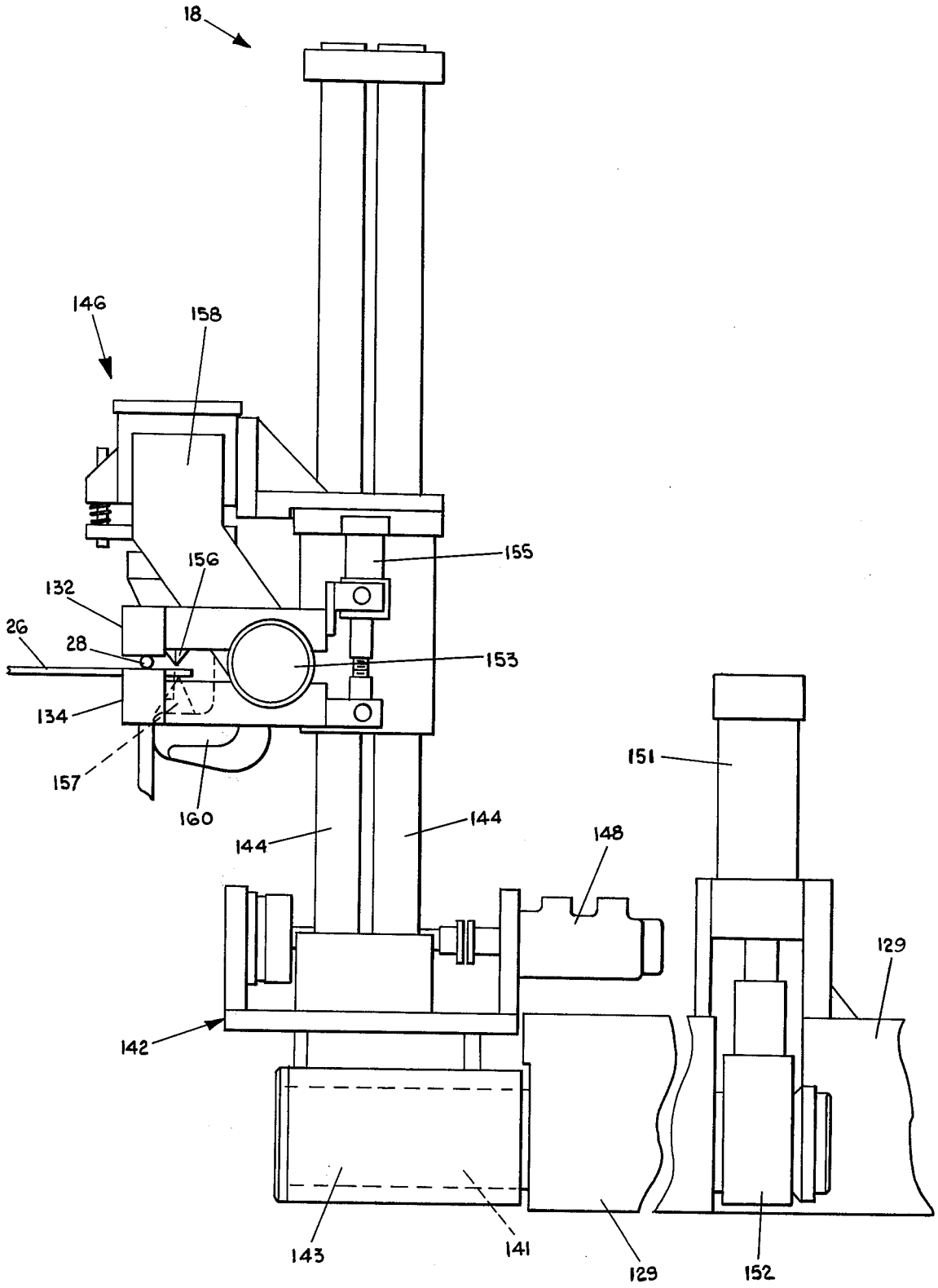
FIG. 23 is fragmentary side elevational view of the wire cutter and trimming assembly.
Figure 24:
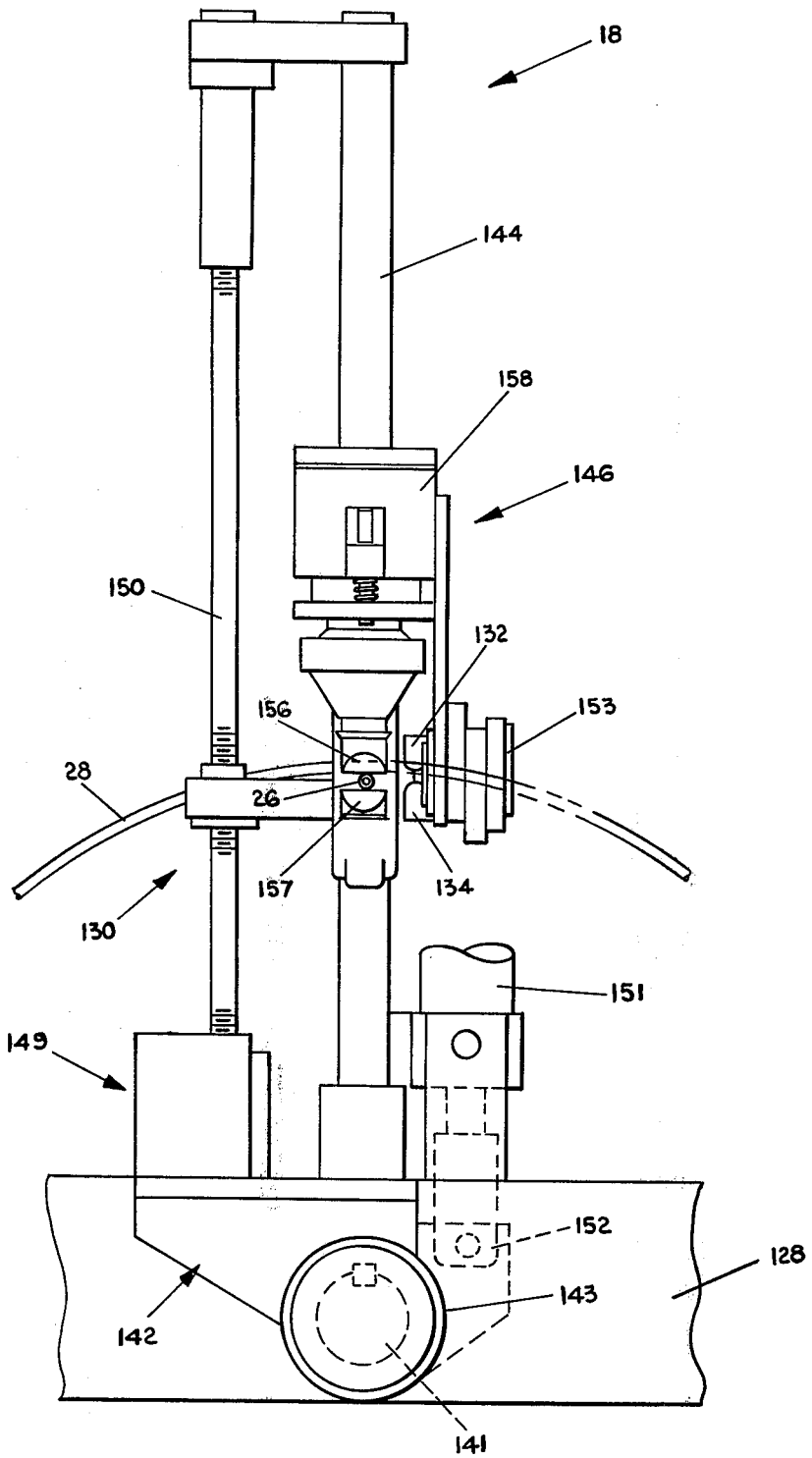
FIG. 24 is a front view of the cutter assembly shown in FIG. 8.

Trimmer assembly 18 is mounted for pivotal movement in the direction a cage rotates and for axial movement on a support frame 128 (FIGS. 1 and 23). Trimmer 18 is also movably vertically by means of vertical adjustment means 130 (FIG. 24). Support frame 128 (FIG. 1) is supported on the upper front horizontal member 106 for movement transverse thereto (FIG. 1), i.e., fore and aft of the machine. The trimmer carriage 129 is mounted for sliding movement on a pair of support and guide rods 138 (FIG. 1) slidably received in a mounting 139 fixed relative to horizontal member 106. Movement of trimmer assembly 18 in a fore and aft direction is controlled by a hydraulic cylinder 140 connected to mounting 139 in a conventional manner such that extension of its piston rod (not shown) will urge the trimmer to advance axially along the apparatus from the forward end 102 toward carriage 14 such that a first pair of jaws 132 and 134 on the trimmer will engage the circumferential wires at the end of the cage and a pair of cutting blades 156 and 157 will cut the ends of the transverse wires 26 of the formed cage.

Trimmer assembly 18 is also mounted for pivotal movement on a shaft 141 carried and extending outwardly from carriage 129 toward the rear of the apparatus (FIGS. 23 and 24). The trimmer assembly includes a support base 142 having a mounting sleeve 143 formed at its lower portion which is fixed on and rotates with shaft 141. The upper portion of the base carries a pair of upwardly extending guide rod members 144 upon which the clamp and cutter assembly 146 is mounted for vertical adjustment. Base 142 also carries a drive motor 148 connected through a right angle drive gear assembly 149 to drive a height adjustment screw 150 connected to clamp and cutter assembly 146 to control its vertical position along guide rods 144.

An actuator 151 fixed relative to carriage 129 has its extending piston rod connected to an arm 152 attached to pivot shaft 141 to rotate the shaft and the mechanisms carried thereby to a normal vertical position between cutting operations. The clamp and cutter assembly 146 performs basically two functions after the bell end of the cage is formed. The assembly cuts the transverse wires extending from the bell end of the cage to the proper length and additionally by means of the first or clamping jaws 132 and 134 holds the cage from axial movement as carriage 14 is retracted after forming and trimming operations are completed.

The clamping and cutting assembly including the previously mentioned first pair of jaws 132 and 134 each include an arm extending rearwardly and pivoted about a pin 153. An actuator 155 fixed on one arm and having its piston rod fixed on the other arm operates to close jaws 132 and 134, clamping the circumferential wire formed at the bell end of the wire cage. Sensor means (not shown) is provided to insure that when the circumferential wire is clamped the transverse wire is positioned between a pair of cutting blades 156 and 157. The cutting blades and the operating mechanism therefor including an actuator 158 and the generally C-shaped frame 160 is a conventional commonly commercially available shear assembly and accordingly will not be described in greater detail. In operation with the clamping jaws and cutter blades open, the cage is rotated. When the position of the transverse wire is sensed approaching the vicinity of the cutting blades, clamping jaws 132 and 134 engage the circumferential wire. Cutters 156 and 157 are then operated to cut the transverse wire while at the same time the cage continues to rotate and the cutter assembly pivots about shaft 141. When cutting of the transverse wire is complete, jaws 132 and 134 are released and the cutter and clamping assembly is returned by cylinder 151 operating on clevis 152. The assembly is then in position to sense and cut the next transverse wire as the cage continues its rotation.

OPERATION

In the beginning the various component elements of the pipe cage end forming machine are positioned as shown in FIG. 1. Carriage 14 is retracted or moved toward the rear of the apparatus, support and chucking rollers **20, 20*a* and 30 are lowered and extended to their widest opening, the jaws 74 and 76 of grabber mechanism 22 are opened, trimmmer assembly 18 is retracted toward the front of the machine and the forming head 16 is at its lowered vertical position with rollers 189 and 191 lowered. FIG. 27 shows the spaced receiving positions of top and bottom rollers 188, 190 and 189, 191, respectively. A prefabricated welded wire cage C having a plurality of circumferential wires 28 and transverse wires 26 is positioned from the top of the apparatus in any convenient manner as by an overhead crane or the like such that the centerline of the cage extends parallel to the centerline of the apparatus. Motor 52 is then engaged to rotate spline shaft 58 which in turn operates to move support rollers 20, 20*a* and 30 in chuck-like fashion to raise and center the cage within the apparatus. Simultaneously with movement of the support rollers, the analog mechanism of FIGS. 19, 20 and 21 operates to move forming head 16 upwardly along vertical support post 110 by controlling fluid pressure to hydraulic cylinder 118. As the cage arrives at its generally centered position the jaws of grabber mechanism 22 engage one end of the cage and carriage 14 is advanced toward forming head 16 causing the opposite end of the cage on which the bell is to be formed to come into position between roller assemblies 180 and 181 as shown in FIG. 27. Sensing means (not shown) locates the position of the cage end between the rollers, stopping operation of carriage advance motor 44. Actuator 228 (FIG. 9) is then operated to shift lower rollers 189 and 191 upwardly and into operative working relationship with upper rollers 188 and 190, respectively. As previously noted, the upstream head assembly 181 is generally indentical to the downstream assembly 180. The rollers 188, 189, 190 and 191 are set in motion by operating hydraulic motors 192 and electro hydraulic stepper motors 194 (FIG. 9) such that the wire is moved in the direction indicated by the arrow, that is, right to left. The camber between rollers is taken out. Cylinder 314 (FIG. 12) is then shifted to move heat source 268 and the wire guide assembly 284 into operating position. The wire stretching operation to form the bell end of the cage then commences. Heat source 268 is energized to apply a localized extremely high heat zone along the wire directly above the heat source. The drive for rollers 181 and 180 are set such that the downstream roller assembly 180 operates at a speed in excess of that of the upstream head assembly 181 to thereby apply force between two points along the length of the wire. The wire and the heat source are thus moved relative to one another so that the localized zone of heating on the wire moves along its length. The heat source, as previously mentioned, is sufficiently hot that it lowers the yield point of the wire below that which it will stretch under the force being applied at the two points. Thus, the wire is progressively elongated as the heat source and wire move relative to each other. The rollers cooperatively apply the stretching force to the wire and also move it. As mentioned previously in connection with FIG. 25, the presence of transverse wires may be sensed to monentarily reduce pressure between the rollers to allow passage of the transverse wires. After the wire has been elongated a predetermined amount as it continues its movement between the upstream and downstream rollers, a spray of cooling water from nozzles 270 is applied to cool the wire prior to its entrance between the downstream roller assembly 180. After the circumferential wire or wires have been elongated sufficiently to form the desired bell end configuration of the cage, cylinder 314 is deenergized and guide assembly 284, heat source 268 and cooling nozzles 270 return to their rest position. Simultaneously, truing roller assembly 24 is brought into position by energizing cylinder 336 (FIG. 22) to move truing roller 326 against the outer circumference of the elongated wires. The cage is then rotated sufficiently to assume its generally cylindrical shape. Finally, cylinder 140 is energized shifting carriage 129 forwardly to move trimmer assembly 18 into position. Jaws 132 and 134 grasp the circumferential wire while cutters 156 and 157 sever the extending transverse wires from the formed cage, all as previously described in connection with FIGS. 23 and 24. After the transverse wires are cut, carriage 14** is withdrawn to its original position, the chucking jaws are opened and the completely formed cage may be removed.

Those skilled in the art will also recognize the many aspects and features of the invention which comprise a significant contribution to the art. The invention is uniquely adapted to automatically center, position, form and trim the bell end of the wire cage into the desired configuration. By means of the various adjustable mechanisms in the apparatus, various size wire cages can be handled with equal facility. While the preferred embodiment of the invention has been illustrated and described in detail, it will be recognized that other embodiments and modifications of this invention incorporating the teachings hereof may be made in light of this disclosure. Accordingly, all modifications embodying the principles of this invention are considered as included in the appended claims unless these claims by their language expressly state otherwise.

The embodiments of the invention in which an exclusive property or privilege is claimed are defined as follows:

1. An apparatus for forming an end on a pipe reinforcing cage or the like of a different cross section than the rest of the cage, said cage having circumferential reinforcing means, said apparatus comprising: means for engaging said circumferential reinforcing means at one end of said cage, said engaging means including force means for applying a force between two points on said circumferential reinforcing means; and means for applying heat along said circumferential reinforcing means between said two points; said heating means being adapted to generate sufficient heat to lower the yield point of said circumferential reinforcing means sufficiently to allow changing the cross section of the circumferential reinforcing means at the force level generated between said two points to form said end by changing the length of said circumferential reinforcing means and thereby changing the cross section of the cage at said one end.

2. The end forming apparatus of claim 1 and further including means for moving said circumferential reinforcing means and said heating means with respect to each other and for progressively relatively moving said two points along said circumferential reinforcing means while maintaining force on said circumferential reinforcing means between said two points as they move progressively along said wire, thereby causing cross-sectional change of said one end circumferential reinforcing means uniformly along its entire circumference.

3. The end forming apparatus of claim 2 wherein said heating means and said force means are fixed relative to each other, said force means including means for moving said circumferential reinforcing means past said heating means while simultaneously maintaining force on said circumferential reinforcing means over said heating means.

4. The end forming apparatus of claim 3 wherein said force means includes a pair of spaced-apart sets of roller members engaging said circumferential reinforcing means at said two points, the first of said sets of roller members being located downstream of said heating means and the second of said sets of roller members being located upstream of said heating means, said first set of said roller members downstream of said heating means being rotated at a faster rate than said second set of said upstream rollers whereby said circumferential reinforcing means will have a constant tension applied thereto to progressively elongate said circumferential reinforcing means along its length.

5. The end forming apparatus of claim 4 and further including means for adjusting the rate of rotation of said first and said second sets of roller members with respect to each other.

6. The end forming apparatus of claim 5 and further including cooling means for cooling said circumferential reinforcing means, said cooling means being located between said heating means and said downstream set of rollers.

7. The end forming apparatus of claim 5 and further including means for shifting each said set of roller members into and out of engagement with said circumferential reinforcing means to thereby allow the introduction of said circumferential reinforcing means therebetween when said rollers are shifted out of engagement.

8. The end forming apparatus of claim 7 and further including said first and second sets of roller members each comprising top and bottom rollers for engaging said circumferential reinforcing means on opposite sides thereof; each said set including shift means allowing the top roller of each set to roll up and over spaced cage longitudinal members joined to said circumferential reinforcing means; means for sensing the presence of a cage longitudinal member at said upstream set of roller members, drive correction means operably connected to said downstream rollers and means responsive to said sensing means for gradually and momentarily slowing said first set of downstream rollers as said top upstream roller rolls over said longitudinal member.

9. The apparatus of claim 8 in which each of said drive roller sets includes at least one top roller and at least one bottom roller; said drive means including a bottom roller drive for driving said bottom rollers in both sets; torque applying means operably connected to said top rollers for causing each of said top rollers to act on said circumferential reinforcing means passing thereby with a particular traction and to thereby assist said bottom rollers in moving said circumferential reinforcing means.

10. The apparatus of claim 9 in which said bottom roller drive means comprises an electronic clock emitting pulses at a rate $N_C$; a first logic circuit for determining the ratio $(N_1/N_C)$ of the desired pulse rate $N_1$ for controlling said upstream bottom roller to the pulse rate $N_C$ of said electronic clock as a function of the desired velocity at which material is to be moved through said rollers; a tension correction circuit operably connected to the output of said first logic circuit for establishing a corrected ratio $(N_1/N_C)'$ as a function of the tension sensed between said first and second sets of rollers; tension sensing means operably connected to said first and second sets of rollers and operably connected to said tension correction circuit; a first multiplier circuit operably connected to the output side of said tension correction circuit and to said electronic clock for multiplying $N_C$ by $(N_1/N_C)'$ to yield a value $N_1'$; said first multiplier circuit being operably connected to said upstream bottom roller for driving said upstream bottom roller at a rate equivalent to $N_1'$; a second logic circuit for determining the desired ratio of the desired rate of operation $N_2$ for said downstream bottom roller to said desired rate of operation $N_1$ of said upstream bottom roller as a function of the final desired bell mouth diameter $D_2$ and the initial or starting cage diameter $D_1$; said second logic circuit being operably connected on its output side to a ramp generator which normally outputs a signal equivalent to one and to a second multiplier circuit; a wire sensor operably connected to said ramp generator for sending a start signal to said ramp generator to start the generation of a ramp; said ramp generator also being operably connected to said first multiplier circuit; said ramp generator generating a ramp whose amplitude is determined as a function of $(N_2/N_1)$ and whose pitch is determined as a function of $N_1'$; the output of said ramp generator being operably connected to said second multiplier circuit whereby $(N_2/N_1)$ is multiplied by the output $C_2$ of said ramp generator to yield a corrected ratio $(N_2/N_1)'$; a third multiplier circuit being operably connected to the output side of said second multiplier circuit and being operably connected to the output of said first multiplier circuit whereby $(N_2/N_1)'$ is multiplied by $N_1'$ to yield a pulse rate $N_2'$; and $N_2'$ gate operably connected to the output of said third multiplier circuit; a program circuit for determining whether the bell end of a cage will be stretched or simply rotated for truing operably connected to said $N_2'$ gate for opening said $N_2'$ gate when said bell end is to be stretched; said $N_2'$ gate being operably connected to said downstream bottom roller for driving same at a rate equivalent to $N_2'$ during stretching; and $N_1'$ gate operably connected to the output of said first multiplier circuit and to said program circuit whereby said $N_1'$ gate is open during the truing cycle of said apparatus; said $N_1'$ gate being operably connected to said downstream bottom roller for driving same at a rate equivalent to $N_1'$ during said truing cycle.

11. The apparatus of claim 10 in which said torque applying means comprises: a motor driving a pressure compensated hydraulic pump; a pressure regulator valve operably connected to said pump through which hydraulic fluid is pumped; a downstream hydraulic motor operably connected to said pressure regulator valve and to said downstream roller whereby said downstream roller is rotated as fluid is fed through said downstream hydraulic motor; an upstream hydraulic motor operably connected to the fluid flow downstream side of said downstream hydraulic motor and operably connected to said upstream roller whereby fluid leaving said downstream hydraulic motor drives said upstream hydraulic motor and roller; a valve operably connected to the fluid flow downstream side of siad upstream motor, said valve being adjustable between two positions, one dumping fluid back to a reservoir whereby during the truing cycle for a cage, said upstream and downstream motors are driven at the same rate, and the second position operably connecting said upstream motor to a first pressure relief valve; a second pressure relief valve operably connected to said downstream motor on the downstream fluid flow side thereof and on the downstream fluid flow side of the point of operable connection of said upstream motor to said donwstream motor whereby the magnitude of the drag exerted by said upstream roller can be adjusted as a function of the difference in settings of said first and second pressure relief valves.

12. The apparatus of claim 14 in which each of said drive roller sets includes at least one top roller and at least one bottom roller; said drive means including a bottom roller drive for driving said bottom rollers in both sets; torque applying means operably connected to said top rollers for causing each of said top rollers to act on said circumferential reinforcing means passing thereby with a particular traction and to thereby assist said bottom rollers in moving said circumferential reinforcing means.

13. The apparatus of claim 12 in which said bottom roller drive means comprises an electronic clock emitting pulses at a rate $N_C$; a first logic circuit for determining the ratio $(N_1/N_C)$ of the desired pulse rate $N_1$ for controlling said upstream bottom roller to the pulse rate $N_C$ of said electronic clock as a function of the desired velocity at which material is to be moved through said rollers; a tension correction circuit operably connected to the output of said first logic circuit for establishing a corrected ratio $(N_1/N_C)'$ as a function of the tension sensed between said first and second sets of rollers; tension sensing means operably connected to said first and second sets of rollers and operably connected to said tension correction circuit; a first multiplier circuit operably connected to the output side of said tension correction circuit and to said electronic clock for multiplying $N_C$ by $(N_1/N_C)'$ to yield a value $N_1'$; said first multiplier circuit being operably connected to said upstream bottom roller for driving said upstream bottom roller at a rate equivalent to $N_1'$; a second logic circuit for determining the desired ratio of the desired rate of operation $N_2$ for said downstream bottom roller to said desired rate of operation $N_1$ of said upstream bottom roller as a function of the final desired bell mouth diameter $D_2$ and the initial or starting cage diameter $D_1$; said second logic circuit being operably connected on its output side to a ramp generator which normally outputs a signal equivalent to one and to a second multiplier circuit; a wire sensor operably connected to said ramp generator for sending a start signal to said ramp generator to start the generation of a ramp; said ramp generator also being operably connected to said first multiplier circuit; said ramp generator generating a ramp whose amplitude is determined as a function of $(N_2/N_1)$ and whose pitch is determined as a function of $N_1'$; the output of said ramp generator being operably connected to said second multiplier circuit whereby $(N_2/N_1)$ is multiplied by the output $C_2$ of said ramp generator to yield a corrected ratio $(N_2/N_1)'$; a third multiplier circuit being operably connected to the output side of said second multiplier circuit and being operably connected to the output of said first multiplier circuit whereby $(N_2/N_1)'$ is multiplied by $N_1'$ to yield a pulse rate $N_2'$; and $N_2'$ gate operably connected to the output of said third multiplier circuit; a program circuit for determining whether the bell end of a cage will be stretched or simply rotated for truing operably connected to said $N_2'$ gate for opening said $N_2'$ gate when said bell end is to be stretched; said $N_2'$ gate being operably connected to said downstream bottom roller for driving same at a rate equivalent to $N_2'$ during stretching; an $N_1'$ gate operably connected to the output of said first multiplier circuit and to said program circuit whereby said $N_1'$ gate is open during the truing cycle of said apparatus; said $N_1'$ gate being operably connected to said downstream bottom roller for driving same at a rate equivalent to $N_1'$ during said truing cycle.

14. The apparatus of claim 13 in which said torque applying means comprises: a motor driving a pressure compensated hydraulic pump; a pressure regulator valve operably connected to said pump through which hydraulic fluid is pumped; a downstream hydraulic motor operably connected to said pressure regulator valve and to said downstream roller whereby said downstream roller is rotated as fluid is fed through said downstream hydraulic motor; an upstream hydraulic motor operably connected to the fluid flow downstream side of said downstream hydraulic motor and operably connected to said upstream roller whereby fluid leaving said downstream hydraulic motor drives said upstream hydraulic motor and roller; a valve operably connected to the fluid flow downstream side of said upstream motor, said valve being adjustable between two positions, one dumping fluid back to a reservoir whereby during the truing cycle for a cage, said upstream and downstream motors are driven at the same rate, and the second position operably connecting said upstream motor to a first pressure relief valve; a second pressure relief valve operably connected to said downstream motor on the downstream fluid flow side thereof and on the downstream fluid flow side of the point of operable connection of said upstream motor to said downstream motor whereby the magnitude of the drag exerted by said upstream roller can be adjusted as a function of the difference in settings of said first and second pressure relief valves.

15. The end forming apparatus of claim 7 and further including a supporting framework for holding said cage, said supporting framework including positioning means for positioning said cage into alignment with said first and said second sets of rollers.

16. The apparatus of claim 15 in which said positioning means comprise: a carriage movably mounted on said frame; chuck means mounted on said carriage; chuck drive means for opening and closing said chuck means; chuck rollers on said chuck means for rotatably engaging a cage such that said chuck rollers will rotate when said cage is rotated.

17. The apparatus of claim 16 including former positioning means for positioning said roller means; analogue control means for coordinating movement of said chuck means and said former positioning means, said analogue control means comprising: cam means operably connected to said former for moving up and down therewith; a cam follower engaging said cam means and being operably connected to a first input on a mechanical integrator means; said chuck drive means being operably connected to a second input on said mechanical integrator means whereby the position of said chuck and the position of said former are integrated by said mechanical integrator means; regulator means operably connected to said mechanical integrator means and to said former positioning means whereby the position of said former is controlled as a function of the output of said mechanical integrator means.

18. The end forming apparatus of claim 9 including: means for trimming the cage longitudinal wires extending perpendicular to said circumferential reinforcing means after said bell end is formed.

19. The apparatus of claim 10 wherein said trimming means includes a first clamping jaw assembly adapted to engage said circumferential wire adjacent said longitudinal wire, and a cutter member adapted to sever said adjacent longitudinal wire; means pivotally mounting said trimming means for movement between first and second positions with rotation of said cage for cutting said longitudinal wire while said cage is rotated toward said second position; and means for returning said trimming means to said first position after said longitudinal wire is cut.

20. The apparatus of claim 2 including quenching means positioned adjacent said heating means and downstream thereof in the direction said circumferential reinforcing means moves relative to said heating means.

21. Apparatus for forming the end of a pipe reinforcing cage or the like having circumferential reinforcing means, said apparatus comprising: means for engaging said circumferential reinforcing means at one end of said cage, said engaging means including a pair of spaced-apart sets of drive rollers engaging said circumferential reinforcing means at two spaced points, the first of said sets of rollers being located downstream of the second of said sets of rollers; drive means rotating said first and second set of rollers, said first set of said rollers being rotated at a different rate than said second set of said upstream rollers, whereby said circumferential reinforcing means will have a constant force applied thereto to progressively change the circumference of said one end circumferential reinforcing means and thereby change the cross section of said one cage end.

22. The end forming apparatus of claim 21 and further including means for adjusting the rate of rotation of said first and said second sets of roller members with respect to each other.

23. The end forming apparatus of claim 21 and further including means for shifting each said set of roller members into and out of engagement with said circumferential reinforcing means to thereby allow the introduction of said circumferential reinforcing means therebetween when said rollers are shifted out of engagement.

24. The end forming apparatus of claim 21 and further including said first and second sets of roller members each comprising top and bottom rollers for engaging said circumferential reinforcing means on opposite sides thereof; each said set including shift means allowing the top roller of each set to roll up and over spaced cage longitudinal members joined to said circumferential reinforcing means; means for sensing the presence of a cage longitudinal member at said upstream set of roller members, drive correction means operably connected to said downstream roller and means responsive to said sensing means for gradually and momentarily slowing said first set of downstream rollers as said top upstream roller rolls over said longitudinal member.

25. The apparatus of claim 24 in which each of said drive roller sets includes at least one top roller and at least one bottom roller; said drive means including a bottom roller drive for driving said bottom rollers in both sets; torque applying means operably connected to said top rollers for causing each of said top rollers to act on said circumferential reinforcing means passing thereby with a particular traction and to thereby assist said bottom rollers in moving said circumferential reinforcing means.

26. The apparatus of claim 25 in which said bottom roller drive means comprises an electronic clock emitting pulses at a rate $N_C$; a first logic circuit for determining the ratio $(N_1/N_C)$ of the desired pulse rate $N_1$ for controlling said upstream bottom roller to the pulse rate $N_C$ of said electronic clock as a function of the desired velocity at which material is to be moved through said rollers; a tension correction circuit operably connected to the output of said first logic circuit for establishing a corrected ratio $(N_1/N_C)'$ as a function of the tension sensed between said first and second sets of rollers; tension sensing means operably connected to said first and second sets of rollers and operably connected to said tension correction circuit; a first multiplier circuit operably connected to the output side of said tension correction circuit and to said electronic clock for multiplying $N_C$ by $(N_1/N_C)'$ to yield a value $N_1'$; said first multiplier circuit being operably connected to said upstream bottom roller for driving said upstream bottom roller at aa rate equivalent to $N_1'$; a second logic circuit for determining the desired ratio of the desired rate of operation $N_2$ for said downstream bottom roller to said desired rate of operation $N_1$ of said upstream bottom roller as a function of the final desired bell mouth diameter $D_2$ and the initial or starting cage diameter $D_1$; said second logic circuit being operably connected on its output side to a ramp generator which normally outputs a signal equivalent to one and to a second multiplier circuit; a wire sensor operably connected to said ramp generator for sending a start signal to said ramp generator to start the generation of a ramp; said ramp generator also being operably connected to said first multiplier circuit; said ramp generator generating a ramp whose amplitude is determined as a function of $(N_2/N_1)$ and whose pitch is determined as a function of $N_1'$; the output of said ramp generator being operably connected to said second multiplier circuit whereby $(N_2/N_1)$ is multiplied by the output $C_2$ of said ramp generator to yield a corrected ratio $(N_2/N_1)'$; a third multiplier circuit being operably connected to the output side of said second multiplier circuit and being operably connected to the output of said first multiplier circuit whereby $(N_2/N_1)'$ is multiplied by $N_1'$ to yield a pulse rate $N_2'$; an $N_2'$ gate operably connected to the output of said third multiplier circuit; a program circuit for determining whether the bell end of a cage will be stretched or simply rotated for truing operably connected to said $N_2'$ gate for opening said $N_2'$ gate when said bell end is to be stretched; said $N_2'$ gate being operably connected to said downstream bottom roller for driving same at a rate equivalent to $N_2'$ during stretching; and $N_1'$ gate operably connected to the output of said first multiplier circuit and to said program circuit whereby said $N_1'$ gate is open during the truing cycle of said apparatus; said $N_1'$ gate being operably connected to said downstream bottom roller for driving same at a rate equivalent to $N_1'$ during said truing cycle.

27. The end forming apparatus of claim 21 and further including a supporting framework for holding said cage, said supporting framework including means for positioning said cage into alignment with said first and said second sets of rollers.

28. The end forming apparatus of claim 21 including: means for trimming the longitudinal wires extending perpendicular to said circumferential reinforcing means after said end is formed.

29. The apparatus of claim 28 wherein said trimming means includes a first clamping jaw assembly adapted to engage said circumferential reinforcing means adjacent said longitudinal wire, and a cutter member adapted to sever said adjacent longitudinal wire; means pivotally mounting said trimming means for movement between first and second positions with rotation of said cage for cutting said longitudinal wire while said cage is rotated toward said second position; and means for returning said trimming means to said first position after said longitudinal wire is cut.

30. Apparatus for trimming the extending ends of longitudinal wires on a welded wire reinforcing cage formed of a plurality of circumferential and longitudinal wires, said apparatus comprising: positioning means for positioning said cage for rotation about its longitudinal axis; rotating means for rotating said cage about said axis; and trimming means positioned at one end of said positioning means for severing said extending ends of said longitudinal wires as they are rotated into position adjacent said trimming means.

31. The apparatus of claim 30 with said trimming means including a first clamping jaw assembly adapted to engage a circumferential wire adjacent said extending ends of said longitudinal wires, a cutter member adapted to sever said extending end of said longitudinal wire; means pivotally mounting said trimming means for movement between first and second positions with rotations of said cage for cutting said longitudinal wire while said cage is rotated toward said second position; and means for returning said trimming means to said first position after said longitudinal wire is cut.

32. The trimming apparatus of claim 31 wherein said means for rotating said cage includes at least one roller member engaging said circumferential wire and means for driving said roller member to thereby rotate said cage about said axis.

33. Apparatus for positioning and rotating a pipe reinforcing fabric cage or the like to facilitate construction operations thereon, said apparatus comprising: an elongated supporting framework; a carriage mounted on said framework and shiftable between first and second positions; chuck means in said carriage adapted to receive and position said cage with respect to its longitudinal axis; means for rotating said cage; chuck drive means for opening and closing said chuck means; chuck rollers on said chuck means for rotatably engaging a cage such that said chuck rollers will rotate when said cage is rotated.

34. The apparatus of claim 33 wherein said rotating means includes at least a pair of roller members adapted to receive the end of said cage therebetween when said carriage means shifts to its said second position, means for shifting said pair of roller members toward and away from each other, into and out of engagement with said cage to thereby allow the introduction of a circumferential wire of a cage therebetween when said rollers are shifted out of engagement, and roller drive means for rotating at least one of said pair of roller members to rotate said cage about said axis.

35. The apparatus of claim 34 including positioning means for adjusting the position of said rotating means; analogue means operably connected to said positioning means and to said chuck means for coordinating the relative movements thereof.

36. The apparatus of claim 35 in which said analogue means comprises: cam means operably connected to said rotating means for moving up and down therewith; a cam follower engaging said cam means and being operably connected to a first input on a mechanical integrator means; said chuck drive means being operably connected to a second input on said mechanical integrator means whereby the position of said chuck and the position of said rotating means are integrated by said mechanical integrator means; regulator means operably connected to said mechanical integrator means and to said positioning means whereby the position of said rotating means is controlled as a function of the output of said mechanical integrator means.

37. The method of forming the end on a closed loop member such as a pipe reinforcing cage or the like, said method comprising the steps of:

engaging said closed loop member at least at one end thereof at two spaced points;

applying force between said two points on said engaged portion;

applying a heat source to a localized zone along said engaged portion between said two points sufficient to lower the yield point of the engaged portion material to allow a change in the cross section of said engaged portion at the force level generated between said two points.

38. The method of claim 37 comprising moving said engaged portion and said heat source with respect to each other and progressively relatively moving said two points along said engaged portion thereby causing a change in the cross section of the material of said engaged portion along its entire length and an attendant change in its circumference.

39. The method of claim 38 wherein the step of applying force between said two points along said circumferential reinforcing means and said step of moving the circumferential reinforcing means with respect to said heat source comprises placing said circumferential reinforcing means between a pair of spaced-apart sets of roller members which engage the circumferential reinforcing means at said two points, rotating both sets of rollers in the same direction, but rotating the first set of rollers which is located upstream from the heat source at a lesser rate than the second set of rollers which is located downstream of the heat source.

40. The method of claim 39 and further including the step of cooling said circumferential reinforcing means after said heating step is performed as said circumferential reinforcing means is moved relative to said heat source.

41. The method of claim 40 and further including the step of trimming the longitudinal wires extending perpendicular to the circumferential reinforcing means after the end is formed.

42. The method of claim 37 in which said closed loop member includes a plurality of circumferential wires, said method of engaging said closed loop member at least at one end thereof comprising engaging at least one of said circumferential wires.

43. The method of claim 42 in which said step of applying a force between said two points comprises applying a tension force such that said engaged portion is elongated during performance of the method.

44. The method of forming at least the end on a closed loop member such as a pipe reinforcing cage or the like, said method comprising: engaging said closed loop member at least at one end thereof with a pair of spaced-apart sets of rollers; rotating both sets of rollers in the same direction, rotating the first set of rollers at a lesser rate of rotation than the second set of rollers whereby said closed loop member is rotated and simultaneously changed in cross-sectional shape at least at the portion thereof engaged by said two spaced roller sets.

45. The method of claim 44 in which said closed loop member includes a plurality of circumferential wires, said method of engaging said closed loop member at least at one end thereof comprising engaging at least one of said circumferential wires.

46. The method of claim 44 in which said first set of rollers is located upstream from said second set of rollers relative to the direction of rotation of the cage through said rollers such that said engaged one end portion of said closed loop member is elongated during performance of the method.

47. A method for forming at least the end on a closed loop member such as a pipe reinforcing cage or the like, said method comprising: applying a concentrated heat with a heat source to said closed loop member at least at one end thereof while simultaneously applying an elongating force to at least heated segment; progressively moving said heat source around the circumference of said closed loop member at least at said one end thereof and applying said force to each progressively heated segment to thereby eventually elongate said closed loop member at least at said one end thereof.

48. The method of claim 47 in which said closed loop member includes a plurality of circumferential wires, said method of engaging said closed loop member at least at one end thereof comprising engaging at least one of said circumferential wires.

49. An apparatus for forming the end on a reinforcing cage comprising: a frame; cage engaging means at one end of said frame for engaging said cage and holding it against axial shifting; end forming means at the other end of said frame for forming an end on said cage; means for rotating said cage; truing roller means engaging at least the formed end of said cage for truing it after it is formed by said forming means; trimming means for trimming the extending longitudinal wire ends on said cage.

* * * * *